US009104131B1

(12) United States Patent
Yagi

(10) Patent No.: US 9,104,131 B1
(45) Date of Patent: Aug. 11, 2015

(54) OPTICAL SCANNING HEAD, IMAGE PROCESSING APPARATUS, AND NON-TRANSITORY COMPUTER READABLE RECORDING MEDIUM STORING LIGHT INTENSITY CORRECTION CONTROL PROGRAM

(71) Applicant: FUJI XEROX CO., LTD., Toyko (JP)

(72) Inventor: Kyoji Yagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/482,638

(22) Filed: Sep. 10, 2014

(30) Foreign Application Priority Data

Jan. 27, 2014 (JP) ..... 2014-012523

(51) Int. Cl.
*B41J 2/435* (2006.01)
*G03G 15/043* (2006.01)

(52) U.S. Cl.
CPC ..... *G03G 15/043* (2013.01)

(58) Field of Classification Search
USPC ..... 347/236–238, 246, 247
See application file for complete search history.

(56) References Cited

U.S. PATENT DOCUMENTS

2008/0130021 A1* 6/2008 Inoue et al. ..... 358/1.7
2010/0328416 A1* 12/2010 Ikeda et al. ..... 347/236

FOREIGN PATENT DOCUMENTS

JP A-2006-255976 9/2006
JP A-2007-118495 5/2007

* cited by examiner

*Primary Examiner* — Hai C Pham
(74) *Attorney, Agent, or Firm* — Oliff PLC

(57) ABSTRACT

Provided is an optical scanning head including plural light-emitting element arrays that are arranged along a scanning direction, each of which includes plural light-emitting elements, a light-emitting control unit that outputs a light-emitting timing signal generated based on image information to each light-emitting element of the plural light-emitting element arrays to control light emission of the light-emitting element, a storage unit that is common to the plural light-emitting element arrays and stores a correction value of a light intensity variation due to an arrival time difference between the light-emitting timing signals to the plural light-emitting elements, and a correction unit that corrects the light-emitting timing signal based on the correction value.

10 Claims, 10 Drawing Sheets

34

| TABLE COMMON TO RESPECTIVE LIGHT-EMITTING CHIPS | |
|---|---|
| LIGHT-EMITTING THYRISTOR L | CORRECTION VALUE (ADDITION VALUE Δ) |
| L1 | Δ1 |
| L2 | Δ2 |
| L3 | Δ3 |
| ⋮ | ⋮ |
| L128 | Δ128 |

OPTICAL SCANNING HEAD, IMAGE PROCESSING APPARATUS, AND NON-TRANSITORY COMPUTER READABLE RECORDING MEDIUM STORING LIGHT INTENSITY CORRECTION CONTROL PROGRAM

CROSS-REFERENCE TO RELATED APPLICATIONS

This application is based on and claims priority under 35 USC 119 from Japanese Patent Application No. 2014-012523 filed Jan. 27, 2014.

BACKGROUND (i) Technical Field

The present invention relates to an optical scanning head, an image processing apparatus, and a non-transitory computer readable recording medium storing light intensity correction control program.

(ii) Related Art

An electro-photographic image processing apparatus that includes a printer or a copier may perform image formation by irradiating image information onto a photoconductor body that is uniformly charged using an optical recording unit to obtain an electrostatic latent image, by adding toner to the electrostatic latent image for visualization, and by transferring and fixing the toner image onto a recording sheet.

An image processing apparatus that uses, as the optical recording unit, an LED print head (LPH) in which plural light-emitting elements (for example, plural light-emitting diodes (LEDs)) are arranged in a main scanning direction has been proposed.

SUMMARY

According to an aspect of the invention, there is provided an optical scanning head including:

plural light-emitting element arrays that are arranged along a scanning direction, each of which includes plural light-emitting elements;

a light-emitting control unit that outputs a light-emitting timing signal generated based on image information to each light-emitting element of the plural light-emitting element arrays to control light emission of the light-emitting element;

a storage unit that is common to the plural light-emitting element arrays and stores a correction value of a light intensity variation due to an arrival time difference between the light-emitting timing signals to the plural light-emitting elements; and a correction unit that corrects the light-emitting timing signal based on the correction value.

BRIEF DESCRIPTION OF THE DRAWINGS

Exemplary embodiments of the present invention will be described in detail based on the following figures, wherein.

DETAILED DESCRIPTION

Image Processing Apparatus 1

Figure 1:
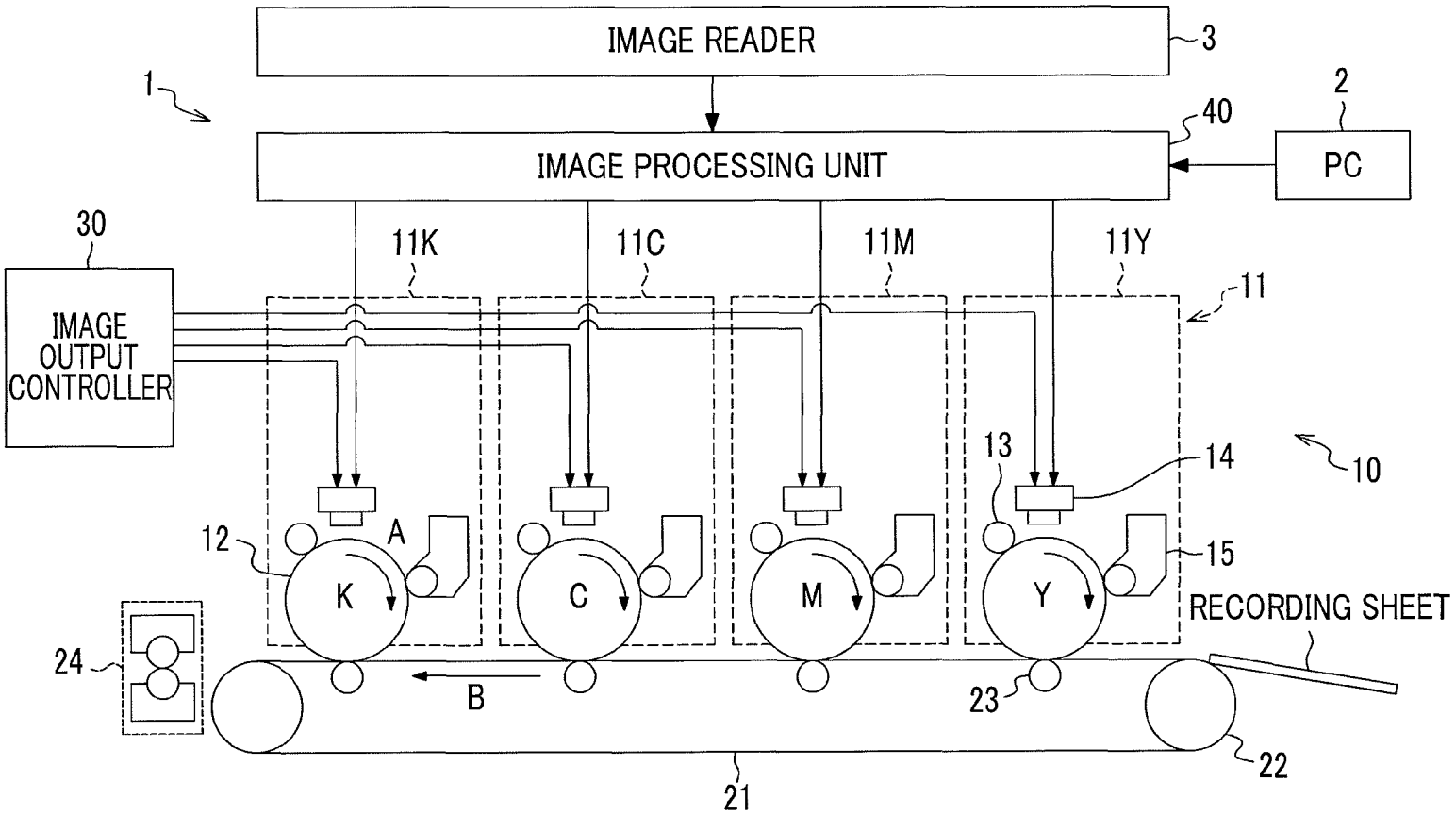
FIG. 1 is a diagram illustrating an example of an entire configuration of an image processing apparatus to which an exemplary embodiment is applied.

FIG. 1 is a diagram illustrating an example of an entire configuration of an image forming apparatus 1 to which an exemplary embodiment is applied.

The image forming apparatus 1 shown in FIG. 1 is an image forming apparatus generally called a tandem type. The image forming apparatus 1 includes an image forming process unit 10 that forms an image corresponding to image data of respective colors, an image output controller 30 that controls the image forming process unit 10, and an image processing unit 40 that is connected to a personal computer (PC) 2 or an image reader 3 and performs a predetermined image processing for image data received from the PC 2 or the image reader 3.

The image forming process unit 10 includes an image forming unit 11 that includes plural engines that are arranged in parallel at predetermined intervals. The image forming unit 11 is provided for each color of yellow (Y), magenta (M), cyan (C) and black (K), and when the image forming units are distinctly mentioned, the image forming units 11 are assigned respectively Y, M, C and K at the end of reference numeral 11 of the image forming unit.

Each of the image forming units 11Y, 11M, 11C, and 11K includes a photoconductor drum 12 that is an example of an image holder that forms an electrostatic latent image to hold a toner image, a charger 13 that is an example of a charger unit that charges a front surface of the photoconductor drum 12 to a predetermined potential, a print head 14 that exposes the photoconductor drum 12 charged by the charger 13, and a developing unit 15 that is an example of a developing unit that develops the electrostatic latent image obtained by the print head 14. Here, the respective image forming units 11Y, 11M, 11C, and 11K have the same configuration except for toner stored in the developing unit 15. Further, the image forming units 11Y, 11M, 11C, and 11K form toner images of yellow (Y), magenta (M), cyan (C), and black (K), respectively.

Further, in order to multilayer-transfer toner images of the respective colors formed by the photoconductor drums 12 of the respective image forming units 11Y, 11M, 11C, and 11K onto a recording sheet that is an example of a transfer target, the image forming process unit 10 includes a sheet transport belt 21 that transports the recording sheet, a drive roller 22 that drives the sheet transport belt 21, a transfer roller 23 that is an example of a transfer unit that transfers the toner image of the photoconductor drum 12 onto the recording sheet, and a fixing unit 24 that fixes the toner image on the recording sheet.

In the image forming apparatus 1, the image forming process unit 10 performs an image forming operation based on various control signals supplied from the image output controller 30.

Further, under the control of the image output controller 30, the image data received from the PC 2 or the image reader 3 is subjected to the image processing by the image processing unit 40 and is supplied to the image forming unit 11. In addition, for example, in the image forming unit 11K of the black (K) color, the photoconductor drum 12 is charged to a predetermined potential by the charger 13 while being rotated in an arrow direction A, and is exposed by the print head 14 that emits light based on the image data supplied from the image processing unit 40. Thus, an electrostatic latent image relating to the black (K) color image is formed on the photoconductor drum 12.

Further, the electrostatic latent image formed on the photoconductor drum 12 is developed by the developing unit 15, and a black (K) color toner image is formed on the photoconductor drum 12. Similarly, in the image forming units 11Y, 11M, and 11C, respective color toner images of yellow (Y), magenta (M), and cyan (C) are formed.

The respective toner images on the photosensitive drum 12 formed by the respective image forming units 11 are sequentially electrostatically transferred by a transfer electric field applied to the transfer roller 23 onto the recording sheet supplied according to movement of the sheet transport belt 21 that moves in an arrow direction B, and thus, a synthesized toner image in which the respective color toners are superposed is formed on the recording sheet.

Then, the recording sheet onto which the synthesized toner image is electrostatically transferred is transported to the fixing unit 24. The synthesized toner image on the recording sheet transported to the fixing unit 24 is subjected to a fixing process using heat and pressure in the fixing unit 24 to be fixed on the recording sheet, and then, is discharged from the image forming apparatus 1.

Print Head 14

Figure 2:
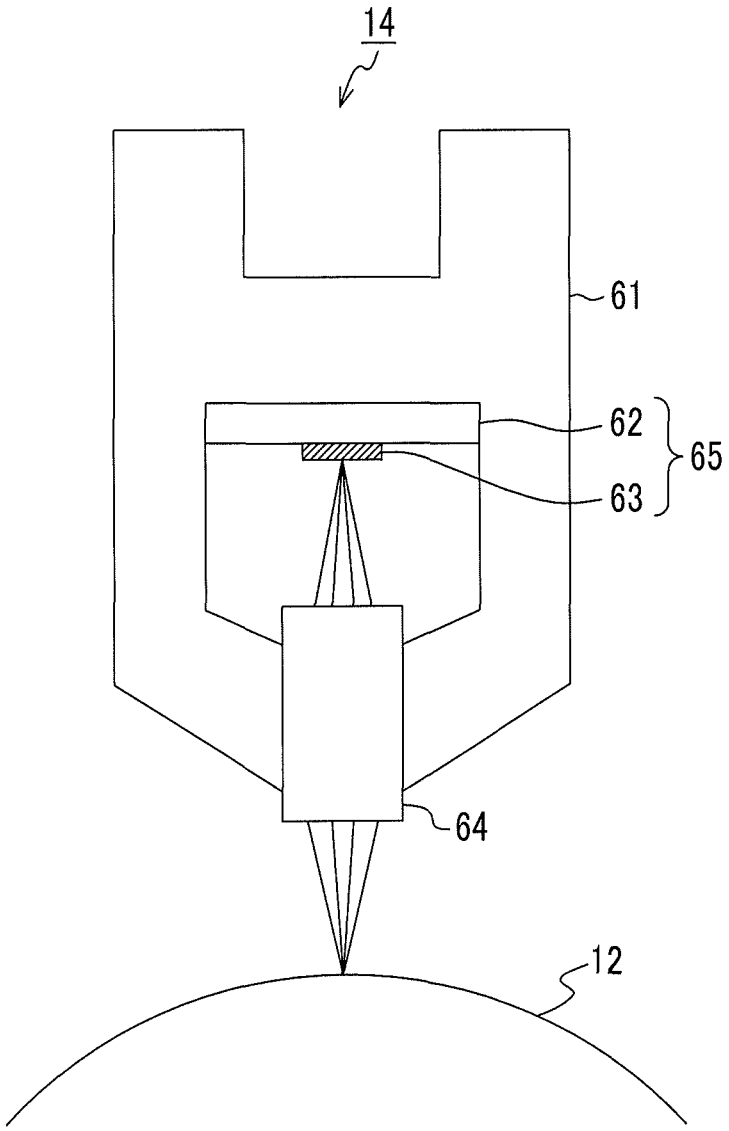
FIG. 2 is a cross-sectional view illustrating a configuration of a print head.

FIG. 2 is a cross-sectional view illustrating a configuration of the print head 14. The print head 14 includes a housing 61, a light-emitting device 65 that is an example of an exposure device that includes a light source unit 63 including plural light-emitting elements (light-emitting thyristors in the present exemplary embodiment) to expose the photoconductor drum 12, and a rod lens array 64 that is an example of an optical unit that forms light emitted from the light source unit 63 into an image on the front surface of the photoconductor drum 12.

The light-emitting device 65 includes the light source unit 63, and a circuit board 62 on which is mounted a signal generating circuit 110 (see FIG. 3 to be described later) that drives the light source unit 63 and the like. The signal generating circuit 110 may not be provided in the light-emitting device 65, but instead, may be provided in the image output controller 30 or the like outside the light-emitting device 65. In this case, a signal or the like supplied to the light source unit 63 by the signal generating circuit 110 is supplied to the light-emitting device 65 from the image output controller 30 or the like through a harness or the like. Hereinafter, it is assumed that the light-emitting device 65 is provided with the signal generating circuit 110.

The housing 61 is formed of a metal, for example, and supports the circuit board 62 and the rod lens array 64. Further, the housing 61 is set so that a light-emitting point in the light-emitting element of the light source unit 63 coincides with a focal plane of the rod lens array 64. Further, the rod lens array 64 is arranged along an axial direction (which is a main scanning direction, that is, an X direction in FIG. 3 and FIG. 4B to be described later) of the photoconductor drum 12.

Light-Emitting Device 65

Figure 3:
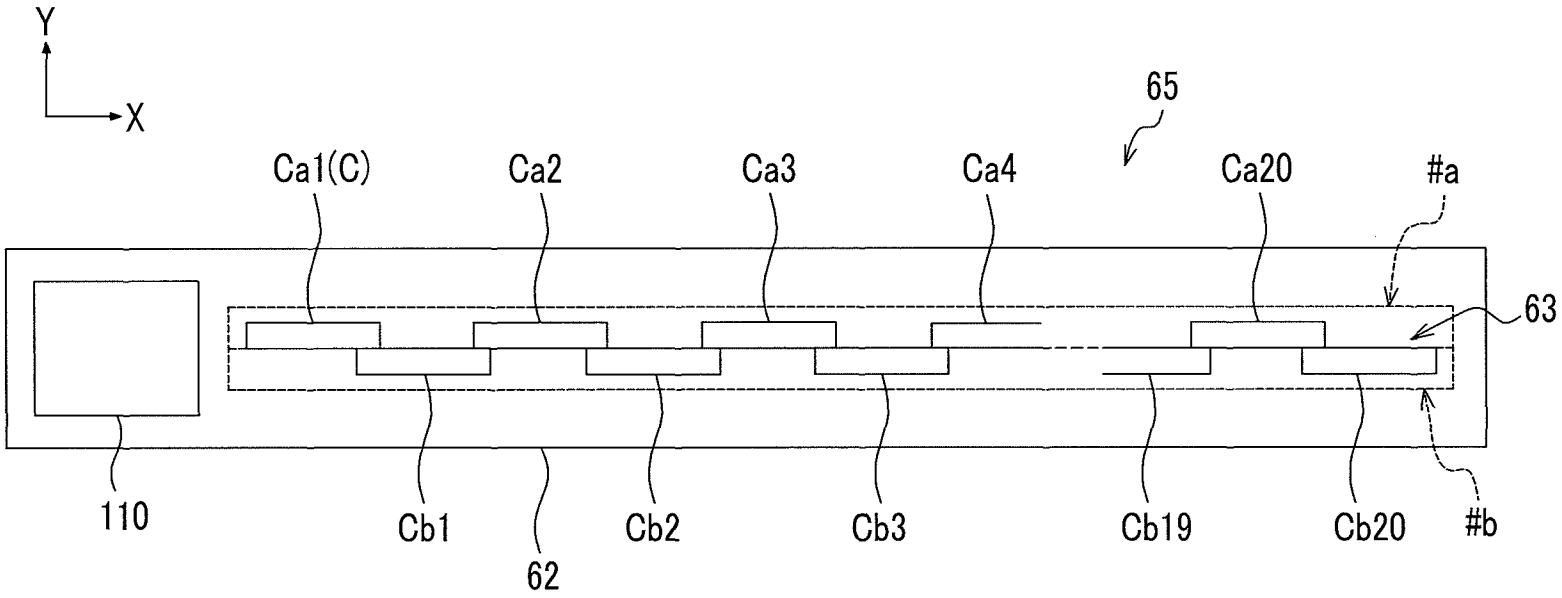
FIG. 3 is a top view of a light-emitting device according to an embodiment.

FIG. 3 is a top view of the light-emitting device 65 according to the present exemplary embodiment.

As shown in FIG. 3, in the light-emitting device 65 according to the present exemplary embodiment, the light source unit 63 is formed by arranging twenty light-emitting chips Ca1 to Ca20 (light-emitting group #a) and twenty light-emitting chips Cb1 to Cb20 (light-emitting group #b) on the circuit board 62 in the main scanning direction in two rows, in zigzags. That is, in the present exemplary embodiment, two light-emitting groups (light-emitting group #a and light-emitting group #b) are provided. Here, the light-emitting group may be abbreviated as a group. Details of a face-to-face arrangement of the light-emitting group #a and the light-emitting group #b will be described later.

In the present exemplary embodiment, "to" represents plural components respectively divided by numbers, which include front and rear components that come before and after "to" and components between the front and rear components. For example, the light-emitting chips Ca1 "to" Ca20 include the light-emitting chips from the light-emitting chip Ca1 to the light-emitting chip Ca20 in a numerical order.

Configurations of the light-emitting chips Ca1 to Ca20 and the light-emitting chips Cb1 to Cb20 may be the same. When not distinctly mentioned, the light-emitting chips Ca1 to Ca20 and the light-emitting chips Cb1 to Cb20 are expressed as a light-emitting chip C. Further, in the present exemplary embodiment, the number of the light-emitting chips C is 40 in total, but the number is not limited thereto.

Further, the signal generating circuit 110 that drives the light source unit 63 is mounted on the light-emitting device 65. As described above, the signal generating circuit 110 may not be mounted on the light-emitting device 65.

Figure 4A:
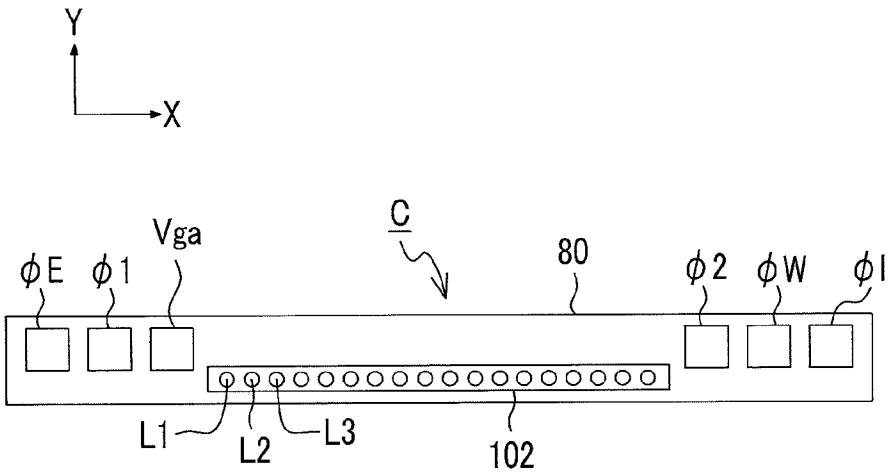
FIGS. 4A and 4B are diagrams illustrating a configuration of a light-emitting chip, a configuration of a signal generating circuit, and a configuration of wirings on a circuit board, according to an embodiment.
Figure 4B:
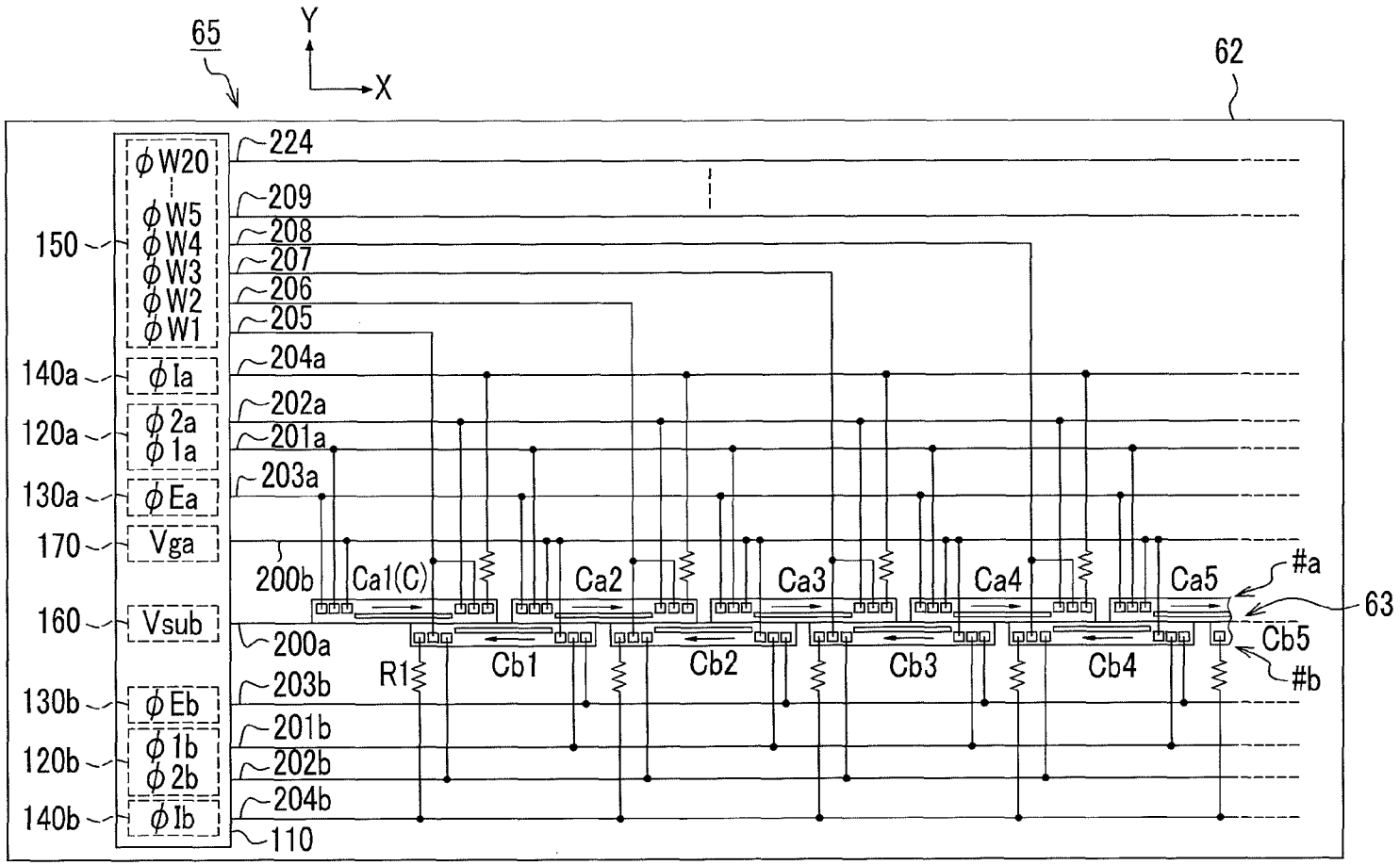

FIGS. 4A and 4B are diagrams illustrating a configuration of the light-emitting chip C, a configuration of the signal generating circuit 110, and a wiring configuration on the circuit board 62 according to the present exemplary embodiment. FIG. 4A shows the configuration of the light-emitting chip C, FIG. 4B shows the configuration of the signal generating circuit 110 of the light-emitting device 65, and the wiring configuration on the circuit board 62. In the present exemplary embodiment, the light-emitting chips C are divided into two light-emitting chip groups (#a and #b).

First, the configuration of the light-emitting chip C shown in FIG. 4A will be described.

The light-emitting chip C includes a light-emitting unit 102 that includes plural light-emitting elements (light-emitting thyristors L1, L2, L3, . . . in the present exemplary embodiment) provided in a row along a long side near one side of the long sides, on a front surface of a substrate 80 of which the surface shape is rectangular. Further, the light-emitting chip C includes input terminals (ϕE terminal, ϕ1 terminal, Vga terminal, ϕ2 terminal, ϕW terminal, and ϕI terminal) that are plural bonding pads for receiving various control signals or the like, at both ends of the substrate 80 in the long side direction. These input terminals are provided in the order of the ϕE terminal, the ϕ1 terminal, and the Vga terminal from one end of the substrate 80, and are provided in the order of the ϕI terminal, the ϕW terminal, and the ϕ2 terminal from the other end of the substrate 80. Further, the light-emitting unit 102 is provided between the Vga terminal and the ϕ2 terminal.

In addition, a rear surface electrode (not shown) is provided as a Vsub terminal, on the rear surface of the substrate 80. Here, the ϕW terminal is an example of a setting terminal, and the ϕE terminal is an example of an enabling terminal.

The "row" is not limited to a case where the plural light-emitting elements are arranged on one straight line as shown in FIG. 4A, and may include a case where the respective plural light-emitting elements are arranged to have different shift amounts in a direction orthogonal to the row direction. For example, the respective light-emitting elements may be arranged to have a shift amount corresponding to several pixels or several tens of pixels in the direction orthogonal to the row direction. Further, the respective light-emitting elements may be alternately arranged in zigzags in adjacent light-emitting elements or every plural light-emitting element.

Next, a configuration of the signal generating circuit 110 of the light-emitting device 65 and the wiring configuration on the circuit board 62 will be described with reference to FIG. 4B.

As described above, on the circuit board 62 of the light-emitting device 65, the signal generating circuit 110 and the light emitting chips C (light-emitting chips Ca1 to Ca20 and light-emitting chips Cb1 to Cb20) are mounted, and wirings (lines) that connect the signal generating circuit 110 to the light emitting chips C (light-emitting chips Ca1 to Ca20 and light-emitting chips Cb1 to Cb20) are provided. In FIG. 4B, the light-emitting chips up to Ca5 and Cb5 are shown, and the light-emitting chips Ca6 and Cb6 and thereafter are not shown since the same wiring is repeated.

First, the configuration of the signal generating circuit 110 will be described with reference to FIG. 7.

Figure 7:
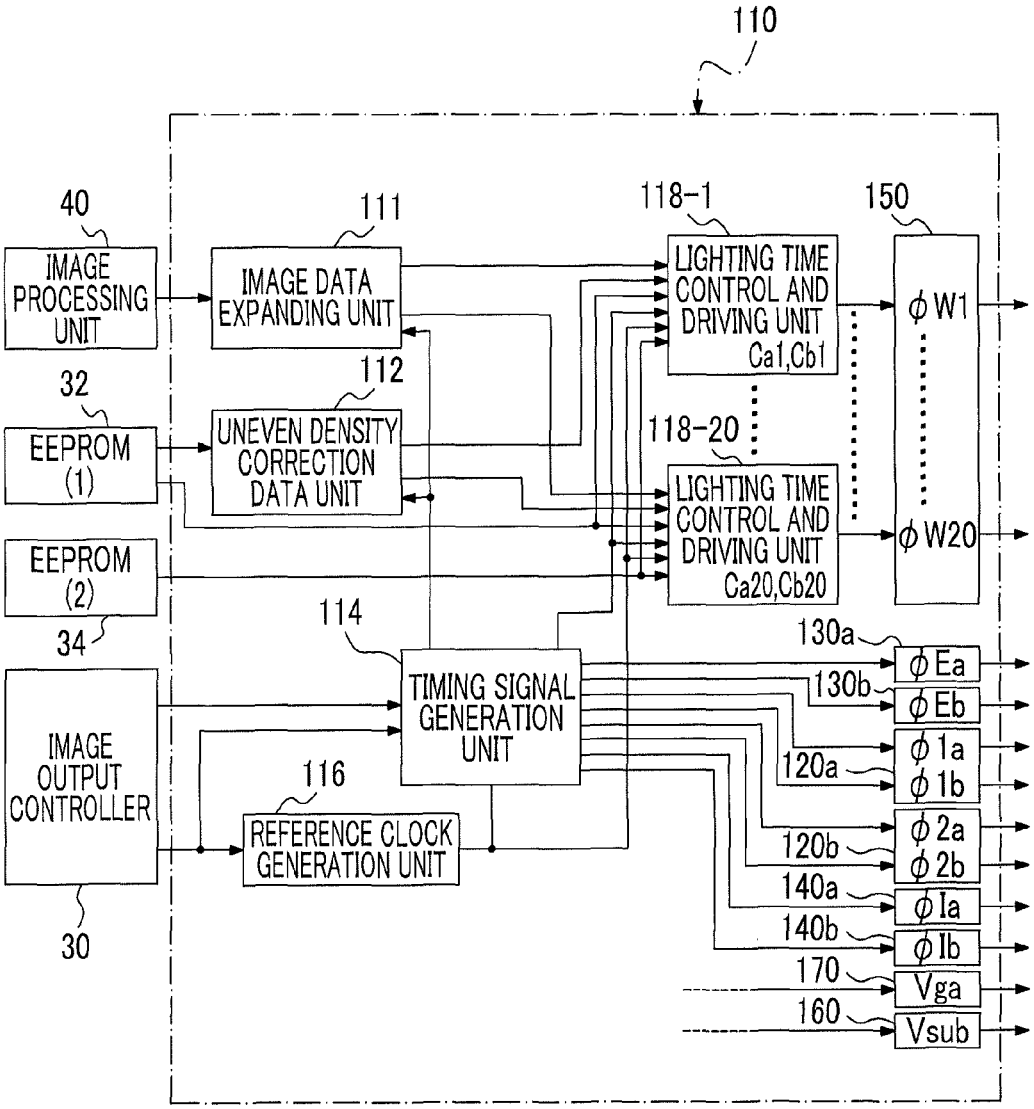
FIG. 7 is a block diagram illustrating a signal generating circuit according to an embodiment.

FIG. 7 is a block diagram illustrating the configuration of the signal generating circuit 110. The signal generating circuit 110 includes an image data expanding unit 111, an uneven density correction data unit 112, a timing signal generation unit 114, a reference clock generation unit 116, lighting time control and driving units 118-1 to 118-20 provided corresponding to the respective light-emitting chips (light-emitting chip groups Ca1 and Cb1 to Ca20 and Cb20).

The lighting time control and driving units 118-1 to 118-20 are respectively connected to a setting signal generation unit 150. Further, the timing signal generation unit 114 is connected to enabling signal generation units 130*a* and 130*b*, transfer signal generation units 120*a* and 120*b*, and lighting signal generation units 140*a* and 140*b*. In addition, in the signal generating circuit 110, respective potentials are output from a power source potential supply unit 170 and a reference potential supply unit 160.

Image data is serially transmitted to the image data expanding unit 111 from the image processing unit (image processor) 40. The image data expanding unit 111 divides the transmitted image data into image data for each of the light-emitting chips C (light-emitting chip groups Ca1 and Cb1 to Ca20 and Cb20), for example, into first to $128^{th}$ dots, $129^{th}$ to $256^{th}$ dots, and so on.

The image data expanding unit 111 is connected to the lighting time control and driving units 118-1 to 118-20, and outputs the divided image data to the corresponding lighting time control and driving units 118-1 to 118-20, respectively.

In the uneven density correction data unit 112, uneven density correction data for correcting uneven image density during image formation due to light intensity deviation or the like of the respective light-emitting thyristors in the light-emitting chip C is stored. Further, the uneven density correction data unit 112 outputs the uneven density correction data to the lighting time control and driving units 118-1 to 118-20, in synchronization with a data reading signal from the uneven density correction data unit 112.

The uneven density is caused by a light intensity characteristic of an individual light-emitting thyristor, which is different from a light intensity characteristic in which a main cause is an electric resistance p due to a difference of wiring lengths to each light-emitting thyristor to be described later.

In an EEPROM (1) 32, uneven density correction data for each light-emitting thyristor (hereinafter, referred to as "individual difference light intensity correction value data") is stored. Further, when machine power is supplied, the individual difference light intensity correction value data for each light-emitting thyristor is downloaded to the uneven density correction data unit 112 from the EEPROM (1) 32.

Further, the reference clock generation unit 116 is connected to the image output controller 30, the timing signal generation unit 114, and the lighting time control and driving units 118-1 to 118-20.

The reference clock generation unit 116 includes a PLL circuit (not shown) and a lookup table (LUT), is supplied with a control voltage corresponding to a frequency that divides a lighting enabling period into 256, generates a reference clock signal of the frequency, and outputs the result to all the lighting time control and driving units 118-1 to 118-20.

The timing signal generation unit 114 is connected to the image output controller 30 and the reference clock generation unit 116, and generates a transfer signal, in synchronization with a horizontal sync signal (Lsync) from the image output controller 30, based on the reference clock signal from the reference clock generation unit 116.

Further, the timing signal generation unit 114 is connected to the uneven density correction data unit 112 and the image data expanding unit 111, and outputs a data reading signal for reading image data corresponding to each pixel (each light-emitting thyristor) from the image data expanding unit 111 and a data reading signal for reading individual difference light intensity correction value data corresponding to each pixel from the uneven density correction data unit 112 to the uneven density correction data unit 112 and the image data expanding unit 111, respectively, based on the reference clock signal from the reference clock generation unit 116 in synchronization with the Lsync signal from the image output controller 30.

In addition, the timing signal generation unit 114 is also connected to the lighting time control and driving units 118-1 to 118-20, and outputs a trigger signal of a lighting start of the light-emitting thyristor in synchronization with the Lsync signal from the image output controller 30 based on the reference clock signal from the reference clock generation unit 116.

Further, the lighting time control and driving units 118-1 to 118-20 set a lighting time (lighting pulse width) of each pixel (each light-emitting thyristor) based on the individual difference light intensity correction value data and linearity correction value data, and generate control signals (setting signals indicating light-emitting start timings) ϕW1 to ϕW20 for lighting respective LEDs of the light-emitting chips.

As described above, in the light-emitting device 65, it may be understood that the light-emitting timings when the respective light-emitting thyristors L1, L2, L3, . . . of the light-emitting chips Ca1 to Ca20 and Cb1 to Cb20 emit light depend on twenty setting signals ϕW1 to ϕW20.

Physical wiring lengths for twenty setting signals ϕW1 to ϕW20, that is, wiring lengths from an output end of the signal generating circuit 110 to the respective light-emitting thyristors L1, L2, L3, . . . vary according to design of the substrate 80 (see FIG. 4A). In the substrate 80, differences of the physical wiring lengths based on a wiring pattern on the substrate 80 have linear characteristics to some extent, but are basically non-linear.

Thus, due to the difference of the electric resistance ρ due to the physical wiring lengths for twenty setting signals ϕW1 to ϕW20, arrival times with respect to transmission times of twenty setting signals ϕW1 to ϕW20 vary, and thus, light intensity variation occurs in the light-emitting thyristors L1, L2, L3 . . . even in signals indicating the same light intensity.

That is, the electric resistance ρ is expressed as R·A/L (Ω·m), and the electric resistance R (Ω) is directly proportional to the length L(m) of the wiring and is inversely proportional to a cross-section area A ($m^2$).

Thus, in the present exemplary embodiment, offset correction value data that corrects the light intensity variation due to the positions (difference of wiring lengths) of the respective light-emitting thyristors L1, L2, L3, . . . (in the present exemplary embodiment, 128 light-emitting thyristors L1 to L128 are arranged) shown in FIG. 4A is stored in an EEPROM (2) 34. Here, it is assumed that the cross-section areas of the wirings are the same.

The offset correction value data is different from the individual difference light intensity correction value data that is corrected by the above-mentioned uneven density correction data unit 112.

The offset correction value data functions to make the times of the output timings of the setting signals ϕW1 to ϕW20 earlier, and an offset correction quantitative value (addition values Δ1 to Δ128) for each of the respective light-emitting thyristors L1, L2, L3, . . . is stored in the EEPROM (2) 34. The respective light-emitting thyristors L1, L2, L3, . . . in which the offset correction value is added have a long light-emitting time, and thus, the light intensity increases.

Figures 8A, 8B:
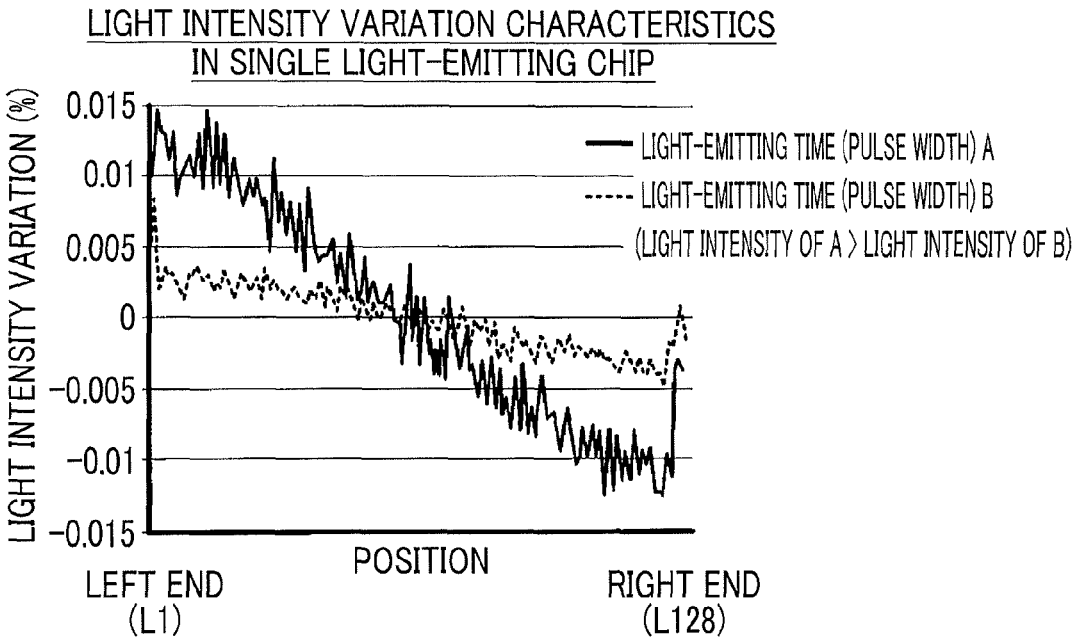
FIG. 8A is a characteristic diagram illustrating a light intensity variation due to a wiring length difference in one light-emitting chip.
FIG. 8B is a lookup table illustrating offset correction data (addition values) with respect to light emitting thyristors, stored in EEPROM.

FIG. 8A is a characteristic diagram illustrating light intensity variation due to a wiring length difference in one light-emitting chip C. In FIG. 8A, the light intensity at a left end having a short wiring length becomes the highest, and the light intensity at a right end having a long wiring length becomes the lowest. Further, as the lighting time (time from lighting start to lighting end) becomes longer, a light intensity difference between the maximum value and the minimum value tends to increase.

The tendency of rightward decrease in FIG. 8A is due to an output source of the setting signals ϕW1 to ϕW20 being provided at the left end of the light-emitting chip C, and the characteristics change according to the position of the output source. For example, when the output source is provided at the center, the characteristics have a mount shape, when the output source is provided at the right end, the characteristics have a rightward increasing shape, and when the output source is separately provided at the right and left ends, the characteristics have a valley shape. Accordingly, the characteristics of the light intensity variation are not limited to FIG. 8A, but herein, the description will be made using the characteristics of FIG. 8A as an example.

FIG. 8B shows a lookup table of addition values Δ1 to Δ128 for the light-emitting thyristors L1 to L128 that are commonly applied to the respective light-emitting chips, stored in the EEPROM (2) 34. The addition values Δ1 to Δ128 correspond to time information for making the times of the output timings of the setting signals ϕW1 to ϕW20 earlier, respectively. As the numerical value increases, the output timing becomes earlier.

Accordingly, when the light intensity characteristics of FIG. 8A are corrected, the light-emitting thyristor L1 at the left end having the highest light intensity is used as a reference (Δ1=0), and thereafter, the addition values may be set to increase the light intensities of the light-emitting thyristors L2 to L128 (Δ2 to Δ128>0).

The addition values Δ1 to Δ128 of the respective light-emitting thyristors L1 to L128 may be theoretically calculated based on the physical wiring lengths, but in order to enhance the accuracy, it is preferable to tabulate non-linear information based on an experimental result.

In the signal generating circuit 110 according to the present exemplary embodiment, image data subjected to the image processing and various control signals are input from the image output controller 30 and the image processing unit 40 (see FIG. 1). The signal generating circuit 110 performs rearrangement of the image data, correction of the light intensity, or the like based on the image data and the various control signals.

The signal generating circuit 110 transmits a first transfer signal ϕ1*a* and a second transfer signal ϕ2*a* from the transfer signal generation unit 120*a* to the light-emitting chip group #a (light-emitting chips Ca1 to Ca20), and transmits a first transfer signal ϕ1*b* and a second transfer signal ϕ2*b* from the transfer signal generation unit 120*b* to the light-emitting chip group #b (light-emitting chips Cb1 to Cb20), based on various control signals.

The signal generating circuit 110 transmits an enabling signal ϕEa from the enabling signal generation unit 130*a* to the light-emitting chip group #a (light-emitting chips Ca1 to Ca20), and transmits an enabling signal ϕEb from the enabling signal generation unit 130*b* to the light-emitting chip group #b (light-emitting chips Cb1 to Cb20), based on various control signals.

Furthermore, the signal generating circuit 110 transmits a lighting signal ϕIa from the lighting signal generation unit 140*a* to the light-emitting chip group #a (light-emitting chips Ca1 to Ca20), and transmits a lighting signal ϕIb from the lighting signal generation unit 140*b* to the light-emitting chip group #b (light-emitting chips Cb1 to Cb20), based on the various control signals.

Further, the signal generating circuit 110 transmits, using one light-emitting chip C that belongs to the light-emitting chip group #a and one light-emitting chip C that belongs to the light-emitting chip group #b as one light-emitting chip set, the setting signals ϕW1 to ϕW20 from the setting signal generation unit 150 to each light-emitting chip set based on various control signals.

For example, the setting signal generation unit 150 transmits the setting signal ϕW1 to a light-emitting chip set #1 of the light-emitting chip Ca1 that belongs to the light-emitting chip group #a, and the light-emitting chip Cb1 that belongs to the light-emitting chip group #b. The setting signal generation unit 150 transmits the setting signal ϕW2 to a light-emitting chip set #2 of the light-emitting chip Ca2 that belongs to the light-emitting chip group #a, and the light-emitting chip Cb2 that belongs to the light-emitting chip group #b. Thereafter, similarly, the setting signal generation unit 150 transmits the setting signal ϕW20 to a light-emitting chip set #20 of the light-emitting chip Ca20 that belongs to the light-emitting chip group #a, and the light-emitting chip Cb20 that belongs to the light-emitting chip group #b.

Further, the signal generating circuit 110 supplies a reference potential Vsub that is a reference of an electric potential to the light-emitting chips C (light-emitting chips Ca1 to Ca20 and light emitting chips Cb1 to Cb20) from the reference potential supply unit 160, and supplies a power source potential Vga for driving the light-emitting chips C (light-emitting chips Ca1 to Ca20 and light emitting chips Cb1 to Cb20) from the power source potential supply unit 170.

As described above, in FIGS. 4A and 4B, the transfer signal generation unit 120*a* and the transfer signal generation unit 120*b* are distinctly shown, but may be collectively referred to as a transfer signal generation unit 120, as necessary.

Similarly, the enabling signal generation unit 130*a* and the enabling signal generation unit 130*b* are distinctly shown, but may be collectively referred to as an enabling signal generation unit 130, as necessary.

Further, similarly, the lighting signal generation unit 140*a* and the lighting signal generation unit 140*b* are distinctly shown, but may be collectively referred to as a lighting signal generation unit 140, as necessary.

Similarly, when not distinctly mentioned, the first transfer signal ϕ1*a* and the first transfer signal ϕ1*b* are referred to as a first transfer signal ϕ1, and the second transfer signal ϕ2*a* and the second transfer signal ϕ2*b* are referred to as a second transfer signal ϕ2. Further, when not distinctly mentioned, the first transfer signal ϕ1 and the second transfer signal ϕ2 are referred to as a transfer signal. Similarly, when not distinctly mentioned, the enabling signal ϕEa and the enabling signal ϕEb are referred to as an enabling signal ϕE, the lighting signal ϕIa and the lighting signal ϕIb are referred to as a lighting signal ϕI, and the setting signals ϕW1 to ϕW20 are collectively referred to as a setting signal ϕW.

Next, the arrangement of the light-emitting chips Ca1 to Ca20 and the light-emitting chips Cb1 to Cb20 will be described.

The light-emitting chips Ca1 to Ca20 that belong to the light-emitting chip group #a are arranged in a row in the long side direction of each light-emitting chip at intervals. Similarly, the light-emitting chips Cb1 to Cb20 that belong to the light-emitting chip group #b are arranged in a row in the long side direction of each light-emitting chip at intervals. Further, the light-emitting chips Ca1 to Ca20 that belong to the light-emitting chip group #a, and the light-emitting chips Cb1 to Cb20 that belong to the light-emitting chip group #b are arranged in zigzags in a state of being rotated by 180° so that the long sides close to the light-emitting units 102 that are respectively provided in the light-emitting chips Ca1 to Ca20 and the light-emitting chips Cb1 to Cb20 face each other. Further, the positions of the light-emitting chips C are set so that the light-emitting elements are arranged at predetermined intervals in the main scanning direction between the light-emitting chips C. A direction of array (in the present exemplary embodiment, the order of the light-emitting thyristors L1, L2, L3, . . . ) of the light-emitting elements of the light-emitting unit 102 shown in FIG. 4A is indicated by an arrow, in the light-emitting chips Ca1, Ca2, Ca3, . . . and the light-emitting chips Cb1, Cb2, Cb3, . . . in FIG. 4B.

The wirings (lines) that connect the signal generating circuit 110 to the light-emitting chips C (light-emitting chips Ca1 to Ca20 and the light-emitting chips Cb1 to Cb20) will be described.

A power source line 200*a* that is connected to the Vsub terminal (see FIG. 6 to be described later) provided on the rear surface of the substrate 80 of the light-emitting chip C and is supplied with the reference potential Vsub from the reference potential supply unit 160 is provided on the circuit board 62.

Further, a power source line 200*b* that is connected to the Vga terminal provided in the light-emitting chip C and is supplied with the power source potential Vga for power supply from the power source potential supply unit 170 is provided on the circuit board 62.

Further, on the circuit board 62, a first transfer signal line 201*a* for transmitting the first transfer signal ϕ1*a* to the ϕ1 terminal of the light-emitting chips Ca1 to Ca20 of the light-emitting chip group #a from the transfer signal generation unit 120*a* of the signal generating circuit 110, and a second transfer signal line 202*a* for transmitting the second transfer signal ϕ2*a* to the ϕ2 terminal of the light-emitting chips Ca1 to Ca20 of the light-emitting chip group #a are provided. The first transfer signal ϕ1*a* and the second transfer signal ϕ2*a* are commonly (in parallel) transmitted to the light-emitting chips Ca1 to Ca20 of the light-emitting chip group #a.

Similarly, on the circuit board 62, a first transfer signal line 201*b* for transmitting the first transfer signal ϕ4*b* to the ϕ1 terminal of the light-emitting chips Cb1 to Cb20 of the light-emitting chip group #b from the transfer signal generation unit 120*b* of the signal generating circuit 110, and a second transfer signal line 202*b* for transmitting the second transfer signal ϕ2*b* to the ϕ2 terminal of the light-emitting chips Cb1 to Cb20 of the light-emitting chip group #b are provided. The first transfer signal ϕ1*b* and the second transfer signal ϕ2*b* are commonly (in parallel) transmitted to the light-emitting chips Cb1 to Cb20.

Further, on the circuit board 62, an enabling signal line 203*a* for transmitting the enabling signal ϕEa to the ϕE terminal of the light-emitting chips Ca1 to Ca20 of the light-emitting chip group #a from the enabling signal generation unit 130*a* of the signal generating circuit 110 is provided. The enabling signal ϕEa is commonly (in parallel) transmitted to the light-emitting chips Ca1 to Ca20 of the light-emitting chip group #a.

Further, on the circuit board 62, an enabling signal line 203*b* for transmitting the enabling signal ϕEb to the E terminal of the light-emitting chips Cb1 to Cb20 of the light-emitting chip group #b from the enabling signal generation unit 130*b* of the signal generating circuit 110 is provided. The enabling signal ϕEb is commonly (in parallel) transmitted to the light-emitting chips Cb1 to Cb20 of the light-emitting chip group #b.

Further, on the circuit board 62, a lighting signal line 204*a* for transmitting the lighting signal ϕIa to the ϕI terminal of the light-emitting chips Ca1 to Ca20 of the light-emitting chip group #a from the lighting signal generation unit 140*a* of the signal generating circuit 110 is provided. The lighting signal ϕIa is commonly (in parallel) transmitted to the light-emitting chips Ca1 to Ca20 of the light-emitting chip group #a through a current limiting resistance RI provided with respect to each of the light-emitting chips Ca1 to Ca20.

Similarly, on the circuit board 62, a lighting signal line 204*b* for transmitting the lighting signal ϕIb to the ϕI terminal of the light-emitting chips Cb1 to Cb20 of the light-emitting chip group #b from the lighting signal generation unit 140*b* of the signal generating circuit 110 is provided. The lighting signal ϕIb is commonly (in parallel) transmitted to the light-emitting chips Cb1 to Cb20 of the light-emitting chip group #b through a current limiting resistance RI provided with respect to each of the light-emitting chips Cb1 to Cb20.

The current limiting resistance RI may be provided inside the light-emitting chip C. Further, on the circuit board 62, setting signal lines 205 to 224 that transmit the setting signals ϕW1 to ϕW20 from the setting signal generation unit 150 of the signal generating circuit 110 to each set of the light-emitting chips, in which one light-emitting chip C that belongs to the light-emitting chip group #a and one light-emitting chip C that belongs to the light-emitting chip group #b form a set, are provided.

For example, the setting signal line 205 is connected to the ϕW terminal of the light-emitting chip Ca1 of the light-emitting chip group #a and the ϕW terminal of the light-emitting chip Cb1 of the light-emitting chip group #b, and transmits the setting signal ϕW1 to the light-emitting chip set #1 formed by the light-emitting chip Ca1 and the light-emitting chip Cb1. The setting signal line 206 is connected to the W terminal of the light-emitting chip Ca2 of the light-emitting chip group #a and the ϕW terminal of the light-emitting chip Cb2 of the light-emitting chip group #b, and transmits the setting signal ϕW2 to the light-emitting chip set #2 formed by the light-emitting chip Ca2 and the light-emitting chip Cb2. Thereafter, similarly, the setting signal line 224 is connected to the ϕW terminal of the light-emitting chip Ca20 of the light-emitting chip group #a and the ϕW terminal of the light-emitting chip Cb20 of the light-emitting chip group #b, and transmits the setting signal W20 to the light-emitting chip set #20 formed by the light-emitting chip Ca20 and the light-emitting chip Cb20.

As described above, the reference potential Vsub and the power source potential Vga are commonly transmitted to all the light-emitting chips C on the circuit board 62.

Further, the first transfer signal ϕ1*a*, the second transfer signal ϕ2*a*, the lighting signal ϕIa, and the enabling signal ϕEa are commonly transmitted to the light-emitting chip group #a. Further, the first transfer signal ϕ1*b*, the second transfer signal ϕ2*b*, the lighting signal ϕIb, and the enabling signal ϕEb are commonly transmitted to the light-emitting chip group #b.

On the other hand, the setting signals ϕW1 to ϕW20 are commonly transmitted to each of the light-emitting chip sets #1 to #20 formed by one light-emitting chip C that belongs to the light-emitting chip group #a and one light-emitting chip C that belongs to the light-emitting chip group #b.

Figure 5:
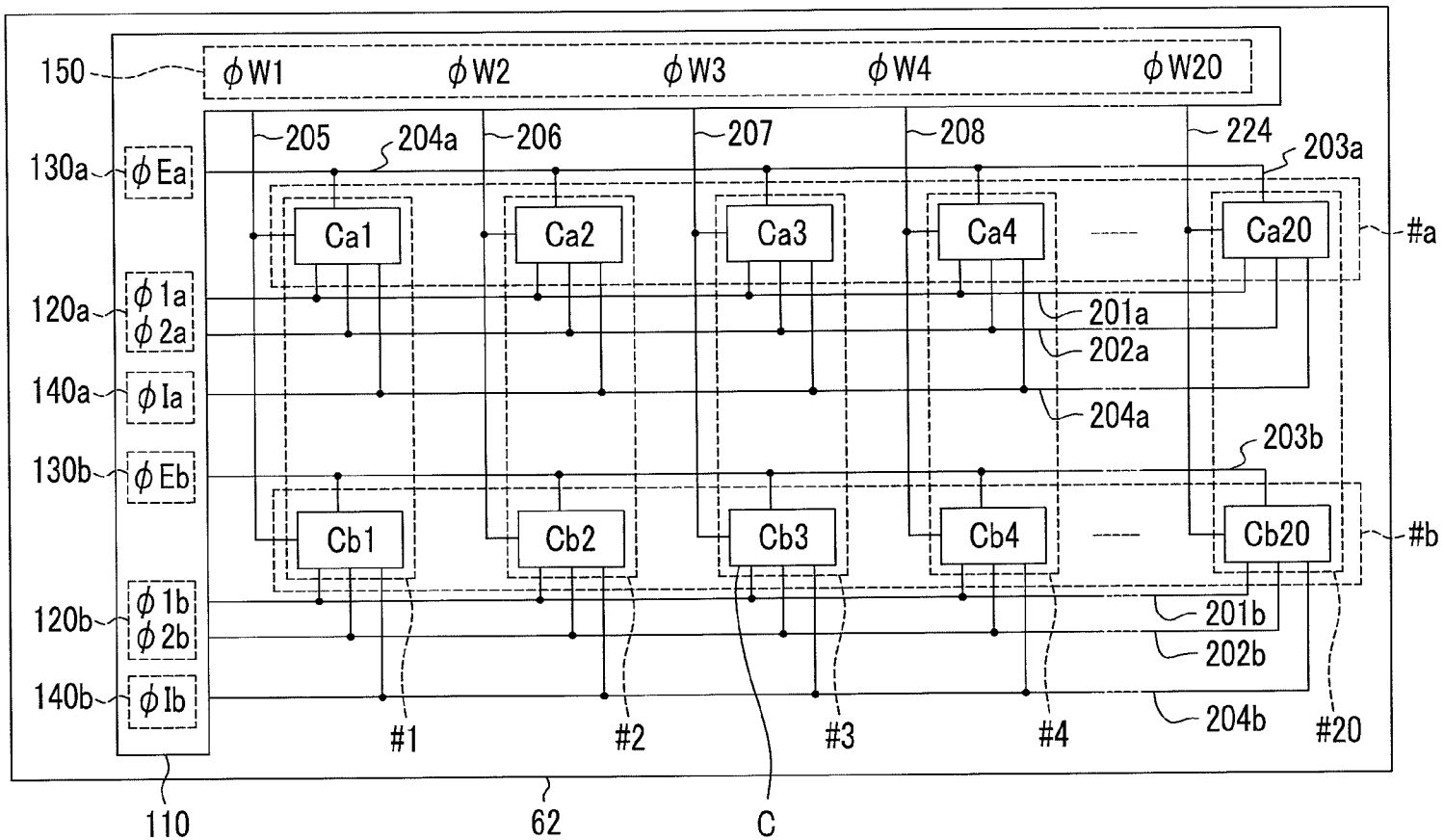
FIG. 5 is a diagram in which a light-emitting chip of a light-emitting device according to an exemplary embodiment is arranged as each element of a matrix.

FIG. 5 is a diagram in which the light-emitting chip of the light-emitting device 65 according to the present exemplary embodiment is arranged as each element of a matrix.

In FIG. 5, the light-emitting chips C (light-emitting chips Ca1 to Ca20 and light-emitting chips Cb1 to Cb20) are arranged as respective elements of a 2×20 matrix, in which only the wirings (lines) of the signals (first transfer signals ϕ1*a* and ϕ1*b*, second transfer signals ϕ2*a* and ϕ2*b*, lighting signals ϕIa and ϕIb, enabling signals ϕEa and ϕEb, and setting signals ϕW1 to ϕW20) that connect the signal generating circuit 110 and the light-emitting chips C (light-emitting chips Ca1 to Ca20 and light-emitting chips Cb1 to Cb20) are shown.

As described above, the first transfer signal ϕ1*a*, the second transfer signal ϕ2*a*, the lighting signal ϕIa, and the enabling signal ϕEa are commonly transmitted to the light-emitting chip group #a. Further, the first transfer signal ϕ1*b*, the second transfer signal ϕ2*b*, the lighting signal ϕIb, and the enabling signal ϕEb are commonly transmitted to the light-emitting chip group #b.

On the other hand, the setting signals ϕW1 to ϕW20 are commonly transmitted to each of the light-emitting chip sets #1 to #20 formed by one light-emitting chip C that belongs to the light-emitting chip group #a and one light-emitting chip C that belongs to the light-emitting chip group #b.

Light-Emitting Chips C

Figure 6:
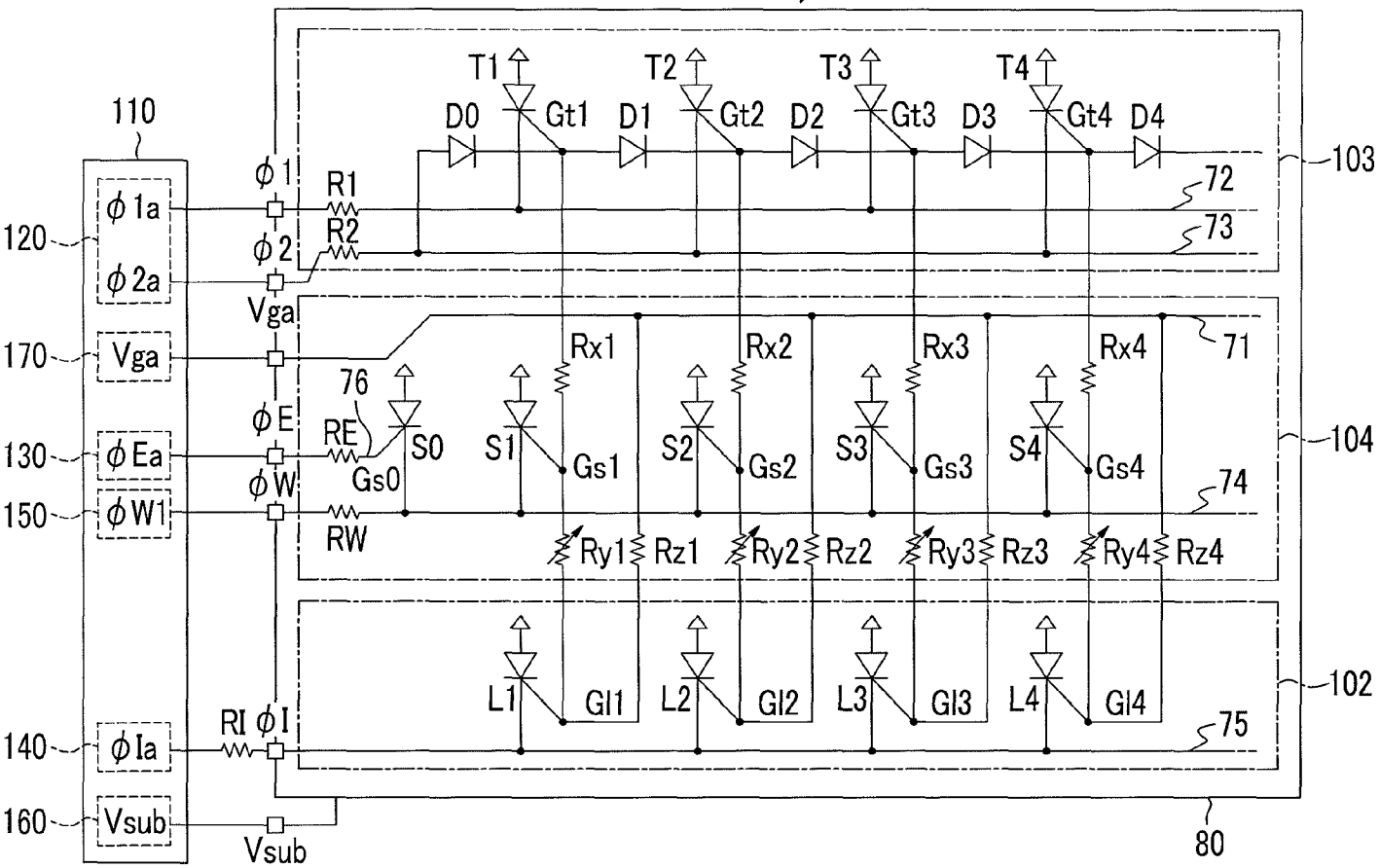
FIG. 6 is an equivalent circuit diagram illustrating a circuit configuration of a light-emitting chip that is a self scanning light-emitting device (SLED) array chip according to an embodiment.

FIG. 6 is an equivalent circuit diagram illustrating a circuit configuration of the light-emitting chip C that is a self scanning light-emitting device (SLED) array according to the present exemplary embodiment Here, the light-emitting chip C will be described using the light-emitting chip Ca1 as an example. Thus, in FIG. 6, the light-emitting chip C is denoted as light-emitting chip Ca1 (C). The configurations of the other light-emitting chips Ca2 to Ca20 and the light-emitting chips Cb1 to Cb20 are the same as the configuration of the light-emitting chip Ca1.

The input terminals (Vga terminal, ϕ1 terminal, ϕ2 terminal, ϕE terminal, ϕW terminal, and ϕI terminal) are shown at the left edge in the figure, for ease of description, differently from terminals in FIG. 4A.

The light-emitting chip Ca1(C) includes a light-emitting thyristor array (light-emitting unit 102 (see FIG. 4A)) that includes the light-emitting thyristors L1, L2, L3, . . . that are arranged in a row on the substrate 80 as described above.

Further, the light-emitting chip Ca1(C) includes a transfer thyristor array that includes transfer thyristors T1, T2, T3, . . . that are arranged in a row similar to the light-emitting thyristor array, and a setting thyristor array that includes setting thyristors S1, S2, S3, . . . that are similarly arranged in a row.

Here, when not distinctly mentioned, the light-emitting thyristors L1, L2, L3, . . . are referred to as a light-emitting thyristor L. When not distinctly mentioned, the transfer thyristors T1, T2, T3, . . . are referred to as a transfer thyristor T. Further, when not distinctly mentioned, the setting thyristors S1, S2, S3, . . . are referred to as a setting thyristor S.

Further, the light-emitting chip Ca1(C) includes a setting enabling thyristor S0. The thyristors (light-emitting thyristor L, transfer thyristor T, setting thyristor S, and setting enabling thyristor S0) are semiconductor elements having three terminals of an anode terminal, a cathode terminal, and a gate terminal.

Here, the anode terminal of the light-emitting thyristor L may be referred to as a first anode terminal, the cathode terminal thereof may be referred to as a first cathode terminal, and the gate terminal thereof may be referred to as a first gate terminal. Similarly, the anode terminal of the setting thyristor S may be referred to as a second anode terminal, the cathode terminal thereof may be referred to as a second cathode terminal, and the gate terminal thereof may be referred to as a second gate terminal. Further, the anode terminal of the transfer thyristor T may be referred to as a third anode terminal, the cathode terminal thereof may be referred to as a third cathode terminal, and the gate terminal thereof may be referred to as a third gate terminal. In addition, the anode terminal of the setting enabling thyristor S0 may be referred to as a fourth anode terminal, the cathode terminal thereof may be referred to as a fourth cathode terminal, and the gate terminal thereof may be referred to as a fourth gate terminal.

Further, the light-emitting chip Ca1(C) is provided with coupling diodes D1, D2, D3, . . . as an example of an electrical unit between each pair that includes two of the respective transfer thyristors T1, T2, T3, . . . in the numerical order.

Further, the light-emitting chip Ca1(C) is provided with connection resistances Rx1, Rx2, Rx3, . . . as an example of a second connection resistance between the transfer thyristors T1, T2, T3, . . . and the setting thyristors S1, S2, S3, etc. Further, the light-emitting chip Ca1(C) is provided with connection resistances Ry1, Ry2, Ry3, . . . as an example of a first connection resistance between the setting thyristors S1, S2, S3, . . . and the light-emitting thyristors L1, L2, L3, etc. The connection resistances Ry1, Ry2, Ry3, . . . have different resistance values between when the setting thyristors S are in a turned-off state and when the setting thyristors S are in a turned-on state, which will be described later. Accordingly, in FIG. 6, arrows are given to the connection resistances Ry1, Ry2, Ry3, . . . , which represents that the resistance value changes.

Further, the light-emitting chip Ca1(C) includes connection resistances Rz1, Rz2, Rz3, . . . as an example of a third connection resistance.

Here, similar to the light-emitting thyristor L or the like, when not distinctly mentioned, the coupling diodes D1, D2, D3, . . . , the connection resistances Rx1, Rx2, Rx3, . . . , the connection resistances Ry1, Ry2, Ry3, . . . , and the connection resistances Rz1, Rz2, Rz3, . . . are respectively referred to as a coupling diode D, a connection resistance Rx, a connection resistance Ry, and a connection resistance Rz.

The number of the light-emitting thyristors L in the light-emitting thyristor array may be a predetermined number. In the exemplary embodiment, for example, if the number of the light-emitting thyristors L is set to 128, the number of the transfer thyristors T and the number of the setting thyristors S are also 128. Similarly, the number of the connection resistances Rx, the connection resistances Ry, and the connection resistances Rz are also 128, respectively. However, the number of the coupling diodes D is 127 smaller than the number of the transfer thyristors T by one.

The number of the transfer thyristors T and the setting thyristors S may be larger than the number of the light-emitting thyristors L, respectively.

Further, the light-emitting chip Ca1(C) is provided with one start diode D0. In addition, the light-emitting chip Ca1(C) is provided with a current limiting resistance RW and a current limiting resistance RE. Furthermore, the light-emitting chip Ca1(C) is provided with a current limiting resistance R1 and a current limiting resistance R2 for preventing excessive current from flowing in a first transfer signal line 72 that transmits the first transfer signal ϕ1 and a second transfer signal line 73 that transmits the second transfer signal ϕ2, to be described later.

The light-emitting thyristors L1, L2, L3, . . . of the light-emitting thyristor array, the transfer thyristors T1, T2, T3, . . . of the transfer thyristor array, and the setting thyristors S1, S2, S3, . . . of the setting thyristor array are arranged in the numerical order from the left side in FIG. 6. Further, the setting enabling thyristor S0 is arranged in parallel with the setting thyristor S1 outside the setting thyristor array.

Further, the coupling diodes D1, D2, D3, . . . , the connection resistances Rx1, Rx2, Rx3, . . . , the connection resistances Ry1, Ry2, Ry3, . . . , and the connection resistances Rz1, Rz2, Rz3, . . . are similarly arranged in the numerical order from the left side in the figure.

In addition, the light-emitting thyristor array, the transfer thyristor array, and the setting thyristor array are arranged in the order of the transfer thyristor array, the setting thyristor array, and the light-emitting thyristor array from the top in FIG. 6.

The transfer thyristor array, the coupling diodes D, the start diode D0, and the current limiting resistances R1 and R2 form a shift unit 103. The setting thyristor array, the connection resistances Rx, the connection resistances Ry, the connection resistances Rz, the setting enabling thyristor S0, the current limiting resistance RW and the current limiting resistance RE form a setting unit 104. The light-emitting thyristor array forms the above-described light-emitting unit 102.

Next, electric connection of respective elements in the light-emitting chip Ca1(C) will be described. The respective anode terminals of the light-emitting thyristor L, the transfer thyristor T, the setting thyristor S, and the setting enabling thyristor S0 are connected to the substrate 80 (common anode).

Further, these anode terminals are connected to the power source line 200*a* (see FIGS. 4A and 4B) through the Vsub terminal that is a rear surface electrode 85 (see FIG. 7 to be described later) provided on the rear surface of the substrate 80. The power source line 200*a* is supplied with the reference potential Vsub from the reference potential supply unit 160.

The cathode terminals of the odd-numbered transfer thyristors T1, T3, . . . in the arrangement of the transfer thyristors T are connected to the first transfer line 72. Further, the first transfer signal line 72 is connected to the ϕ1 terminal that is the input terminal of the first transfer signal ϕ1*a* through the current limiting resistance R1. To the ϕ1 terminal, the first transfer signal line 201*a* (see FIGS. 4A and 4B) is connected, and the first transfer signal ϕ1*a* is transmitted.

On the other hand, the cathode terminals of the even-numbered transfer thyristors T2, T4, . . . in the arrangement of the transfer thyristors T are connected to the second transfer signal line 73. Further, the second transfer signal line 73 is connected to the ϕ2 terminal that is the input terminal of the second transfer signal ϕ2*a* through the current limiting resistance R2. To the ϕ2 terminal, the second transfer signal line 202*a* (see FIGS. 4A and 4B) is connected, and the second transfer signal 2*a* is transmitted.

In the case of the light-emitting chip Cb1, to the ϕ1 terminal, the first transfer signal line 201*b* (see FIGS. 4A and 4B) is connected, and the first transfer signal ϕ1*b* is transmitted. Similarly, to the ϕ2 terminal, the second transfer signal line 202*b* (see FIGS. 4A and 4B) is connected, and the second transfer signal ϕ2*b* is transmitted.

The cathode terminals of the setting thyristors S and the setting enabling thyristor S0 are connected to a setting signal line 74. Further, the setting signal line 74 is connected to the ϕW terminal that is the input terminal of the setting signal ϕW1*l* through the current limiting resistance RW. To the ϕW terminal, the setting signal line 205 (see FIGS. 4A and 4B) is connected, and the setting signal ϕW1 is transmitted.

Further, a gate terminal Gs0 of the setting enabling thyristor S0 is connected to the enabling signal line 76. The enabling signal line 76 is connected to the ϕE terminal that is the input terminal of the enabling signal ϕEa through the current limiting resistance RE. To the ϕE terminal, the enabling signal line 203*a* (see FIGS. 4A and 4B) is connected, and the enabling signal ϕEa is transmitted.

The cathode terminals of the light-emitting thyristors L are connected to a lighting signal line 75. Further, the lighting signal line 75 is connected to the ϕI terminal that is the input terminal of the lighting signal ϕIa. To the ϕI terminal, the lighting signal line 204*a* (see FIGS. 4A and 4B) is connected through the current limiting resistance RI, and the lighting signal ϕIa is transmitted.

Gate terminals Gt1, Gt2, Gt3, . . . of the transfer thyristors T are respectively connected to gate terminals Gs1, Gs2, Gs3, . . . of the setting thyristors S1, S2, S3, . . . having the same number through the connection resistances Rx1, Rx2, Rx3, . . . one to one.

On the other hand, the gate terminals Gs1, Gs2, Gs3, . . . of the setting thyristors S1, S2, S3, . . . are respectively connected to gate terminals Gl1, G12, G13, . . . of the light-emitting thyristors L1, L2, L3, . . . having the same number through the connection resistances Ry1, Ry2, Ry3, . . . one to one.

Here, when not distinctly mentioned, the gate terminals Gt1, Gt2, Gt3, . . . , the gate terminals Gs1, Gs2, Gs3, . . . , and the gate terminal Gl1, G12, G13, . . . are respectively referred to as a gate terminal Gt, a gate terminal Gs, and a gate terminal G1.

The coupling diodes D1, D2, D3, . . . are respectively connected between the pairs of the gate terminals Gt, in which each pair includes two of the respective gate terminals Gt1, Gt2, Gt3, . . . of the transfer thyristors T1, T2, T3, . . . in the numerical order. That is, the coupling diodes D1, D2, D3, . . . are serially connected so that the coupling diodes D1, D2, D3, . . . are sequentially interposed between the gate terminals Gt1, Gt2, Gt3, etc. Further, the coupling diode D1 is connected in a direction where electric current flows from the gate terminal Gt1 to the gate terminal Gt2. This is similarly applied to the other coupling diodes D2, D3, D4, etc.

The gate terminals Gl of the light-emitting thyristors L are connected to a power source line 71 through the connection resistances Rz provided corresponding to the respective light-emitting thyristors L.

Further, the gate terminal Gt1 of the transfer thyristor T1 on one end side of the transfer thyristor array is connected to the cathode terminal of the start diode D0. On the other hand, the anode terminal of the start diode D0 is connected to the second transfer signal line 73.

Operation of Light-Emitting Device 65

Next, the operation of the light-emitting device 65 will be described.

The light-emitting device 65 includes the light-emitting chips Ca1 to Ca20 that belong to the light-emitting chip group #a and the light-emitting chips Cb1 to Cb20 that belong to the light-emitting chip group #b (see FIGS. 3 to 5).

As shown in FIGS. 4A and 4B, the reference potential Vsub and the power source potential Vga are commonly supplied to all the light-emitting chips C (light-emitting chips Ca1 to Ca20 and light emitting chips Cb1 to Cb20) on the circuit board 62.

Further, as described above, the first transfer signal ϕ1*a*, the second transfer signal ϕ2*a*, the lighting signal ϕ1*a*, and the enabling signal ϕEa are commonly transmitted to the light-emitting chips Ca1 to Ca20 of the light-emitting chip group #a. Accordingly, the light-emitting chips Ca1 to Ca20 of the light-emitting chip group #a are driven in parallel.

Similarly, as described above, the first transfer signal ϕ1*b*, the second transfer signal ϕ2*b*, the lighting signal ϕIb, and the enabling signal ϕEb are commonly transmitted to the light-emitting chips Cb1 to Cb20 of the light-emitting chip group #b. Accordingly, the light-emitting chips Cb1 to Cb20 of the light-emitting chip group #b are driven in parallel.

On the other hand, the setting signals ϕW1 to ϕW20 are respectively transmitted to the light-emitting chip sets #1 to #20 formed by one light-emitting chip C of the light-emitting chip group #a and one light-emitting chip C of the light-emitting chip group #b. For example, the setting signal ϕW1 is commonly transmitted to the light-emitting chip set #1 formed by the light-emitting chip Ca1 of the light-emitting chip group #a and the light-emitting chip Cb1 of the light-emitting chip group #b. Further, twenty setting signals ϕW1 to ϕW20 are transmitted in parallel at the same timing. Accordingly, the light-emitting chip sets #1 to #20 are driven in parallel.

As described later, for the light intensity correction of the light-emitting thyristors L, timings of the setting signals ϕW1 to ϕW20 may be shifted for transmission.

Since the light-emitting chips Ca2 to Ca20 of the light-emitting chip group #a are driven in parallel with the light-emitting chip Ca1, and the light-emitting chips Cb2 to Cb20 of the light-emitting chip group #b are driven in parallel with the light-emitting chip Cb1, the description of the light-emitting chips Ca1 and Cb1 that belong to the light-emitting chip set #1 would be enough. Similarly, since the light-emitting chip set #2 to #20 are driven in parallel with the light-emitting chip set #1, the description of the light-emitting chip set #1 to which the light-emitting chips Ca1 and Cb1 belong would be enough.

Hereinafter, effects of the exemplary embodiment will be described.

Control Signal Generation Including Light-Emitting Start Timing

If image data is serially transmitted to the image data expanding unit 111 from the image processing unit (image processor) 40, the image data expanding unit 111 divides the transmitted image data into image data for each light-emitting chip C (light-emitting chip groups Ca1, Cb1 to Ca20, Cb20).

The image data expanding unit 111 outputs the divided image data to the respectively corresponding lighting time control and driving units 118-1 to 118-20.

In the EEPROM (1) 32, when the machine power is supplied, the individual difference light intensity correction value data for each light-emitting thyristor is downloaded. The uneven density correction data unit 112 reads the individual difference light intensity correction value data from the EEPROM (1) 32 in synchronization with a data reading signal, and outputs the result to the lighting time control and driving units 118-1 to 118-20.

Further, in the EEPROM (2) 34, when the machine power is supplied, the offset correction value data for correcting light intensity variation due to the difference of the wiring lengths (electric resistance difference) for each light-emitting thyristor is downloaded to the time control and driving units 118-1 to 118-20.

The offset correction value data outputs the individual difference light intensity correction value data to the time control and driving units 118-1 to 118-20.

The reference clock generation unit 116 generates a reference clock signal, and outputs the result to the timing signal generation unit 114 and all the lighting time control and driving units 118-1 to 118-20.

The timing signal generation unit 114 generates a transfer signal in synchronization with the horizontal sync signal (Lsync) from the image output controller 30 based on the reference clock signal from the reference clock generation unit 116.

Further, the timing signal generation unit 114 outputs a data reading signal for reading image data corresponding to each pixel (each light-emitting thyristor) from the image data expanding unit 111 and a data reading signal for reading individual difference light intensity correction value data corresponding to each pixel from the uneven density correction data unit 112 to the respective lighting time control and driving units 118-1 to 118-20, in synchronization with the Lsync signal from the image output controller 30.

Further, the timing signal generation unit 114 also outputs a trigger signal of a lighting start of the light-emitting thyristor in synchronization with the Lsync signal from the image output controller 30.

The lighting time control and driving units 118-1 to 118-20 set a lighting time (lighting pulse width) of each pixel (each light-emitting thyristor) based on the individual difference light intensity correction value data and linearity correction value data, lastly add the offset correction value data, and generate the control signals (setting signals indicating light-emitting start timings) ϕW1 to ϕW20 for lighting the respective light-emitting thyristors of the light-emitting chips C.

The correction (addition) of the offset correction value data is lastly performed so as not to change an absolute amount depending on other corrections. In other words, the offset correction value data is data that increases base values of the control signals ϕW1 to ϕW20 but does not correct the control signals ϕW1 to ϕW20 at the ratio based on the light intensity.

Further, in the exemplary embodiment, since the maximum light intensity is used as a reference, the addition is performed, but addition and subtraction may be performed using an intermediate light intensity as a reference, or subtraction may be performed using the minimum light intensity as a reference.

Effects Relating to Light Intensity Variation Correction Based on Offset Correction Value Data In the light-emitting device 65 according to the exemplary embodiment, it may be understood that the light-emitting start timings when the respective light-emitting thyristors L1, L2, L3, . . . of the light-emitting chips Ca1 to Ca20 and Cb1 to Cb20 emit light depend on twenty setting signals ϕW1 to ϕW20.

The physical wiring lengths for twenty setting signals ϕW1 to ϕW20, that is, the wiring lengths from the output end of the signal generating circuit 110 to the respective light-emitting thyristors L1, L2, L3, . . . vary according to design of the substrate 80 (see FIG. 4A). In the substrate 80, the differences of the physical wiring lengths based on a wiring pattern on the substrate 80 have linear characteristics to some extent, but are basically non-linear.

Thus, due to the difference of the resistance value (electric resistance ρ) due to the physical wiring lengths for twenty setting signals ϕW1 to ϕW20, arrival times with respect to transmission times of twenty setting signals ϕW1 to ϕW20 vary, and thus, light intensity variation occurs in the light-emitting thyristors L1, L2, L3 . . . even in signals indicating the same light intensity (for example, see FIG. 8A).

FIG. 8A is a characteristic diagram illustrating light intensity variation due to a wiring length difference in one light-emitting chip C. In the case of FIG. 8A, the light-emitting thyristor L1 having the maximum light emission amount positioned at the left end is extracted, and a correction for increasing the light intensities of the other light-emitting thyristors L2 to L128 is performed to match the light emission amount of the light-emitting thyristor L1 having the maximum light intensity.

In FIG. 8A, the light-emitting thyristor L1 at the left end has the maximum light emission amount, but the invention is not limited thereto. For example, a light-emitting thyristor at the center or at the right end thereof may have the maximum light emission amount.

Thus, in the exemplary embodiment, the light intensity variation characteristic information due to the wiring pattern of the substrate 80 to be applied is obtained in advance, and the correction values (offset correction data that increases the light intensity) based on the light intensity variation characteristic information are stored in the EEPROM (2) 34. The light intensity characteristic information may be obtained through an actual measurement, or may be obtained through a calculation, but the obtainment through the actual measurement is preferable in view of accuracy.

The correction for increasing the light intensity using the offset correction value data corresponds to an offset correction for making earlier (or delaying) the times of the output timings of the setting signals ϕW1 to ϕW20, and an offset correction quantitative value (addition value) for each of the respective light-emitting thyristors L1, L2, L3, . . . is stored in the EEPROM 2 (34). If the output timings of the setting signals ϕW1 to ϕW20 are made earlier, the light emission times increase. Further, if the output timings of the setting signals ϕW1 to ϕW20 are delayed, the light emission times decrease.

The correction timings based on the offset correction data in the signal generating circuit 110 shown in FIG. 7 are after the other corrections (rearrangement of the image data, correction of the light intensity for correcting uneven density, or the like) in the lighting time control and driving units 118-1 to 118-20 of the respective light-emitting chips Ca1 to Ca20 and Cb1 to Cb20, and a correction for adding or subtracting the offset correction data read from the EEPROM (2) 34 to or from the output timings of the setting signals ϕW1 to ϕW20 (addition in the exemplary embodiment).

The respective light-emitting chips Ca1 to Ca20 and Cb1 to Cb20 in which the light-emitting thyristors L1, L2, L3, . . . are arranged have a light intensity variation characteristic, respectively. However, since the light intensity variation characteristic depends on the wiring pattern of the substrate 80, the light-emitting chips Ca1 to Ca20 and Cb1 to Cb20 have the same light intensity variation characteristic in the substrate 80 formed by the same wiring pattern. In other words, the respective light-emitting chips Ca1 to Ca20 and Cb1 to Cb20 have a single type of light intensity variation characteristic.

Accordingly, the offset correction data stored in the EEPROM (2) 34 may correspond to one light-emitting chip C. In other words, when plural types of light-emitting chips C having different wiring patterns are applied, the offset correction data based on the types may be stored.

Further, in maintenance of the image forming apparatus 1 after shipping, when the print head 14 is exchanged, the offset correction value data downloaded to the EEPROM (2) 34 when power is supplied thereto may be rewritten.

Light Emission Operation Control of Light-Emitting Chips

Figure 9:
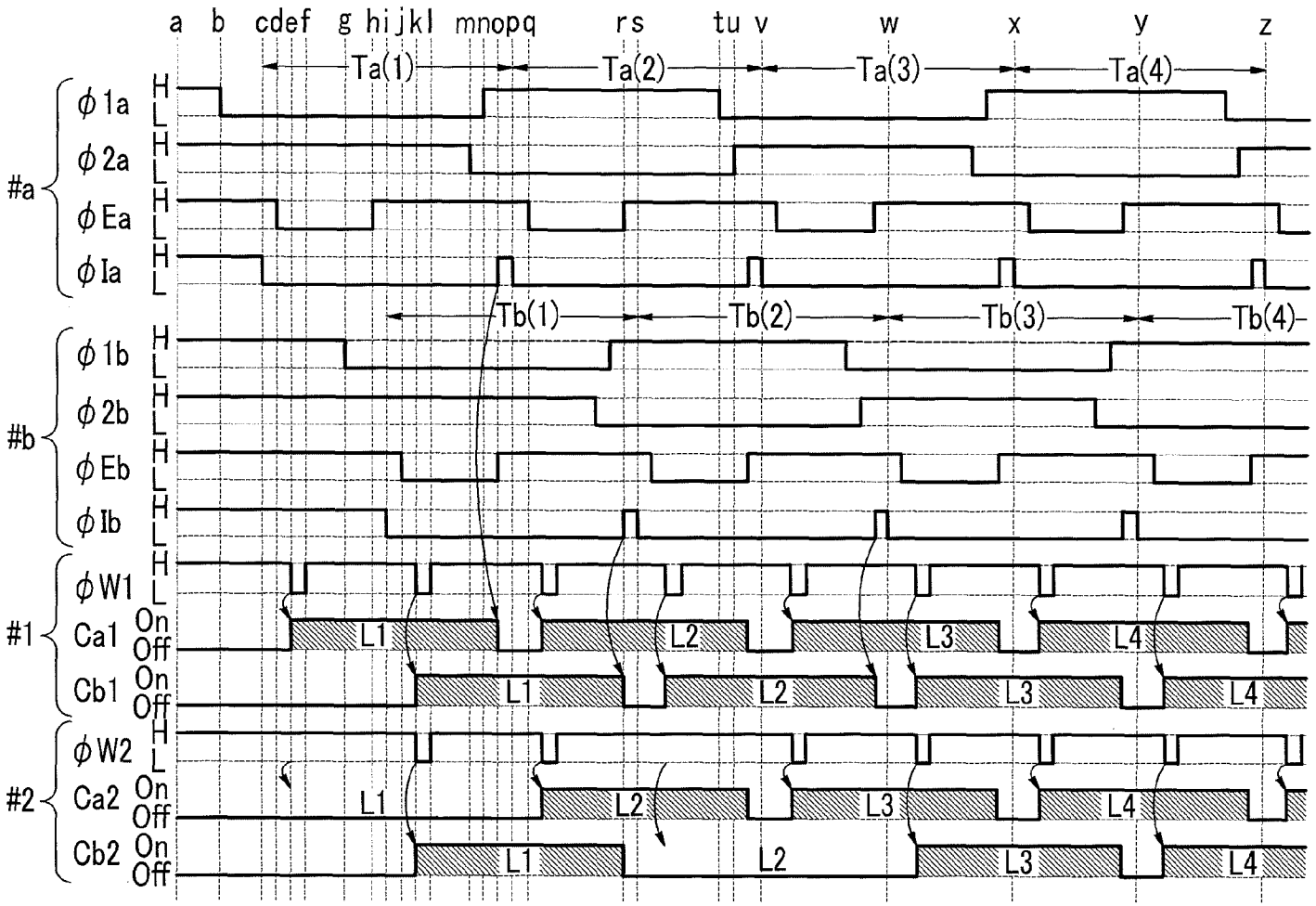
FIG. 9 is a timing chart illustrating operations of a light-emitting device and a light-emitting chip according to an embodiment.

FIG. 9 is a timing chart illustrating operations of the light-emitting device and the light-emitting chip C according to the exemplary embodiment.

In FIG. 9, in addition to the operation of the light-emitting chip set #1 (light-emitting chips Ca1 and Cb1), the operation of the light-emitting chip set #2 (light-emitting chip Ca2 and Cb2) is described. Further, in FIG. 9, portions that control lighting and non-lighting of four light-emitting thyristors L of the light-emitting thyristors L1 to L4 in each light-emitting chip C are shown. The control of the lighting or non-lighting of the light-emitting thyristors L is referred to as a lighting control.

Further, in the light-emitting chip set #1 (light-emitting chips Ca1 and Cb1), it is assumed that the respective light-emitting thyristors L1 to L4 are all lighted. In the light-emitting chip set #2 (light-emitting chips Ca2 and Cb2), it is assumed that the light-emitting thyristors L2, L3, and L4 of the light-emitting chip Ca2 are lighted, and the light-emitting thyristors L1, L3, and L4 of the light-emitting chip Cb2 are lighted. Further, it is assumed that the light-emitting thyristor L1 of the light-emitting chip Ca2, and the light-emitting thyristor L2 of the light-emitting chip Cb2 are not lighted (non-lighting).

Hereinafter, the operation of the light-emitting chips Ca1 and Cb1 will be described.

In FIG. 9, it is assumed that time elapses from time a to time z in the alphabetical order. In the light-emitting chip Ca1 of the light-emitting chip group #a, lighting of the light-emitting thyristor L1 is controlled in period Ta(1) from time c to time p. Lighting of the light-emitting thyristor L2 is controlled in period Ta(2) from time p to time v. Lighting of the light-emitting thyristor L3 is controlled in period Ta(3) from time v to time x. Lighting of the light-emitting thyristor L4 is controlled in period Ta(4) from time x to time z. Thereafter, similarly, lighting of the light-emitting thyristors L of which the number is 5 or greater is controlled.

On the other hand, in the light-emitting chip Cb1 of the light-emitting chip group #b, lighting of the light-emitting thyristor L1 is controlled in period Tb(1) from time i to time s. Lighting of the light-emitting thyristor L2 is controlled in period Tb(2) from time s to time w. Lighting of the light-emitting thyristor L3 is controlled in period Tb(3) from time w to time y. Thereafter, similarly, lighting of the light-emitting thyristors L of which the number is 4 or greater is controlled.

In the exemplary embodiment, the periods Ta(1), Ta(2), Ta(3), . . . , and the periods Tb(1), Tb(2), Tb(3), . . . are set to have the same length of period, and are referred to as a period T when not distinctly mentioned.

Further, it is assumed that the periods Ta(1), Ta(2), Ta(3), . . . when the light-emitting chips Ca1 to Ca20 of the light-emitting chip group #a are controlled, and the periods Tb(1), Tb(2), Tb(3), . . . when the light-emitting chips Cb1 to Cb20 of the light-emitting chip group #b are controlled are shifted from each other by a length corresponding to half the period T (180° in phase). That is, the period Tb(1) starts after the period Ta(1) has started, and then, the period corresponding to half of the period T has elapsed.

Accordingly, hereinafter, the periods Ta(1), Ta(2), Ta(3), . . . when the light-emitting chip Ca1 of the light-emitting chip group #a is controlled will be described.

Here, as long as the correlation of signals to be described hereinafter may be maintained, the length of the period T may be variable.

Signal waveforms in the periods Ta(1), Ta(2), Ta(3), . . . are repetition of the same waveform except for the setting signal ϕW (setting signals ϕW1 to ϕW20) changed by image data.

Accordingly, hereinafter, only the period Ta(1) from time c to time p will be described. A period from time a to time c corresponds to a period when the light-emitting chip Ca1(C) starts the operation. A signal of this period will be described in description of the operation.

The signal waveforms, in the period Ta(1), of the first transfer signal ϕ1*a*, the second transfer signal ϕ2*a*, the enabling signal ϕEa, and the lighting signal ϕIa will be described.

The first transfer signal ϕ1*a* is "L" at time c, transitions to "H" from "L" at time n, and maintains "H" at time p.

The second transfer signal ϕ2*a* is "H" at time c, transitions to "L" from "H" at time m, and maintains "L" at time p.

Here, when comparing the first transfer signal ϕ1*a* with the second transfer signal ϕ2*a*, the waveform of the first transfer signal ϕ1*a* in the period Ta(1) becomes the waveform of the second transfer signal ϕ2*a* in the period Ta(2). Further, the waveform of the second transfer signal ϕ2*a* in the period Ta(1) becomes the waveform of the first transfer signal ϕ1*a* in the period Ta(2).

That is, the first transfer signal ϕ1*a* and the second transfer signal ϕ2*a* are signal waveforms that are repeated in the unit of a period that is twice the period T (2T). Further, "H" and "L" are alternately repeated with a period when both of the first transfer signal ϕ1*a* and the second transfer signal ϕ2*a* are "L" as in a period from time m to time n being interposed between "H" and "L". In addition, the first transfer signal ϕ1*a* and the second transfer signal ϕ2*a* do not have a period when both of the first transfer signal ϕ1*a* and the second transfer signal ϕ2*a* are "H" at the same time, except for a period from time a to time b.

The transfer thyristors T shown in FIG. 6 sequentially enter the turned-on state as described later through one set of transfer signals of the first transfer signal ϕ1*a* and the second transfer signal ϕ2*a*, to designate the light-emitting thyristor L that is a lighting or non-lighting control target (of which lighting is controlled).

The enabling signal ϕEa is "H" at time c, transitions to "L" from "H" at time d, and transitions to "H" from "L" at time h. Further, the enabling signal ϕEa maintains "H" at time p.

The enabling signal ϕEa sets the light-emitting thyristor L that is the lighting or non-lighting control target (of which lighting is controlled) to any one of a lighting enabled state or a lighting unabled state, as described later.

The lighting signal ϕIa transitions to "L" from "H" at time c, and transitions to "H" from "L" at time o. Further, the lighting signal ϕIa maintains "H" at time p.

The lighting signal ϕIa supplies electric current for lighting (light emission) to the light-emitting thyristor L.

The setting signal ϕW1 is "H" at time c, transitions to "L" from "H" at time e, and transitions to "H" from "L" at time f. Further, the setting signal ϕW1 transitions to "L" from "H" at time k, and transitions to "H" from "L" at time l. That is, the setting signal ϕW1 has two "L" periods in the period Ta(1).

Further, from the relationship between the setting signal ϕW1 and the enabling signal ϕEa, the setting signal ϕW1 is "L" in the period from time e to time f included in the period from time d to time h when the enabling signal ϕEa is "L".

On the other hand, from the relationship between the setting signal ϕW1 and the enabling signal ϕEb of which the phase is shifted by 180° with respect to the enabling signal ϕEa, the setting signal ϕW1 is "L" in the period from time k to time l included in the period from time j to time o when the enabling signal ϕEb in the period Tb(1) is "L".

That is, in the period Ta(1), the period (from time e to time f) when the setting signal ϕW1 is first "L" corresponds to a signal for transitioning the light-emitting thyristor L1 of the light-emitting chip Ca1 to the lighted state, and the period (from time k to time l) when the setting signal ϕW1 becomes "L" later corresponds to a signal for transitioning the light-emitting thyristor L1 of the light-emitting chip Cb1 to the lighted state.

Thus, the period (from time d to time h) when the enabling signal ϕEa is "L" is set not to be overlapped with the period (from time k to time l) when the setting signal ϕW1 is "L" in order to transition the light-emitting thyristor L1 of the light-emitting chip Cb1 to the lighted state. Similarly, the period (from time j to time o) when the enabling signal ϕEb is "L" is set not to be overlapped with the period (from time e to time f) when the setting signal ϕW1 is "L" in order to transition the light-emitting thyristor L1 of the light-emitting chip Ca1 to the lighted state.

Next, the operation of the light-emitting device 65 will be described according to the timing chart shown in FIG. 9 with reference to FIGS. 4A to 6. The connection resistance Rx, resistance Rv, resistance Rv', resistance Ru, and connection resistance Rz will be given the above-described values for description.

(1) Time a

The state (initial state) at time a when the supply of the reference potential Vsub and the power source potential Vga to the light-emitting device 65 is started will be described.

Light-Emitting Device 65

At time a of the timing chart shown in FIG. 9, the power source line 200*a* is set to the reference potential Vsub of "H" (0 V), and the power source line 200*b* is set to the power source potential Vga of "L" (−3.3 V) (see FIGS. 4A and 4B). Accordingly, the respective Vsub terminals of all the light-emitting chips C (light-emitting chips Ca1 to Ca20 and light-emitting chips Cb1 to Cb20) are set to "H", and the respective Vga terminals are set to "L" (see FIG. 6).

Further, the transfer signal generation unit 120*a* of the signal generating circuit 110 sets the first transfer signal ϕ1*a* and the second transfer signal ϕ2*a* to "H", respectively, and the transfer signal generation unit 120*b* sets the first transfer signal ϕ1*b* and the second transfer signal ϕ2*b* to "H", respectively. Then, the first transfer signal lines 201*a* and 201*b* and the second transfer signal lines 202*a* and 202*b* become "H" (see FIGS. 4A and 4B). Thus, the ϕ1 terminal and the ϕ2 terminal of each of the light-emitting chips C (light-emitting chips Ca1 to Ca20 and light-emitting chips Cb1 to Cb20) become "H". The first transfer signal line 72 connected to the ϕ1 terminal through the current limiting resistance R1, and the second transfer signal line 73 connected to the ϕ1 terminal through the current limiting resistance R2 all become "H" (see FIG. 6).

Further, the enabling signal generation unit 130*a* of the signal generating circuit 110 sets the enabling signal ϕEa to "H", and the enabling signal generation unit 130*b* sets the enabling signal ϕEb to "H". Then, the enabling signal lines 203*a* and 203*b* become "H" (see FIGS. 4A and 4B). Thus, the E terminal of the light-emitting chip C becomes "H", and the enabling signal line 76 connected to the ϕE terminal through the current limiting resistance RE becomes "H" (see FIG. 6).

Furthermore, the lighting signal generation unit 140*a* of the signal generating circuit 110 sets the lighting signal ϕIa to "H", and the lighting signal generation unit 140*b* sets the lighting signal ϕIb to "H". Then, the lighting signal lines 204*a* and 204*b* become "H" (see FIGS. 4A and 4B). Thus, the ϕI terminal of the light-emitting chip C connected to the lighting signal lines 204*a* and 204*b* through the current limiting resistance RI becomes "H". The lighting signal line 75 connected to the ϕI terminal also becomes "H" (see FIG. 6).

The setting signal generation unit 150 of the signal generating circuit 110 sets the setting signals ϕW1 to ϕW20 to "H". Then, the setting signal lines 205 to 224 become "H" (see FIGS. 4A and 4B). Thus, the ϕW terminal of the light-emitting chip C becomes "H" (see FIG. 6).

The ϕW terminal of the light-emitting chip C is connected to the setting signal line 74 through the current limiting resistance RW. Accordingly, the setting signal line 74 also becomes "H" (see FIG. 6).

Next, the operation of the light-emitting chip C (light-emitting chips Ca1 to Ca20 and light-emitting chips Cb1 to Cb20) will be described according to the timing chart shown in FIG. 9 with reference to FIG. 6, using the light-emitting chips Ca1 and Cb1 that belong to the light-emitting chip set #1 as an example.

In the description of FIG. 9 and thereafter, it is shown that the potentials of the respective terminals change in a step shape, but the potentials of the respective terminals may change gradually. Accordingly, even while the potentials are being changed, as long as the following condition is satisfied, the thyristors cause a state change such as turned-on or turned-off.

Light-Emitting Chip Ca1

The anode terminals of the light-emitting thyristor L, the transfer thyristor T, the setting thyristor S and the setting enabling thyristor S0 are connected to the Vsub terminal, and thus, are set to "H".

The respective cathode terminals of the odd-numbered transfer thyristors T1, T3, T5, . . . are connected to the first transfer signal line 72, and thus, are set to "H". The respective cathode terminals of the even-numbered transfer thyristors T2, T4, T6, . . . are connected to the second transfer signal line 73, and thus, are set to "H". Accordingly, the anode terminals and the cathode terminals of the transfer thyristor T are all "H", and thus, the transfer thyristor T is in the turned-off state.

Similarly, the cathode terminals of the setting thyristor S and the setting enabling thyristor S0 are connected to the setting signal line 74, and thus, are set to "H", as described above. The anode terminals and the cathode terminals of the setting thyristor S and the setting enabling thyristor S0 are all "H", and thus, the setting thyristor S and the setting enabling thyristor S0 are in the turned-off state.

Further, the cathode terminal of the light-emitting thyristor L is connected to the lighting signal line 75, and thus, is set to "H". Accordingly, the anode terminal and the cathode terminal of the light-emitting thyristor L are all "H", and thus, the light-emitting thyristor L is in the turned-off state.

Since all of the light-emitting thyristor L, the transfer thyristor T, and the setting thyristor S are in the turned-off state, the gate terminal Gt of the transfer thyristor T, the gate terminal Gs of the setting thyristor S and the gate terminal G1 of the light-emitting thyristor L are not fixed to "H" (0 V) that is the potential of the anode terminal.

The gate terminal G1 of the light-emitting thyristor L is connected to the power source line 71 through the connection resistance Rz. Accordingly, the potential of the gate terminal G1 becomes "L" (−3.3 V).

Further, the gate terminal Gs of the setting thyristor S is connected to the power source line 71 through the connection resistance Rz and the connection resistance Ry1. Accordingly, the potential of the gate terminal Gs becomes "L" (−3.3 V), except for the gate terminals Gs1 and Gs2 to be described later.

Further, the gate terminal Gt of the transfer thyristor T is connected to the power source line 71 through the connection resistance Rz, the connection resistance Ry and the connection resistance Rx. Accordingly, the potential of the gate terminal Gt becomes "L" (−3.3 V), except for the gate terminals Gt1 and Gt2 to be described later.

As described above, threshold voltages of the transfer thyristor T, the setting thyristor S and the light-emitting thyristor L are respectively −4.8 V obtained by subtracting a diffusion potential Vd (1.5 V) of a pn junction from the potential (−3.3 V) of the respective gate terminals Gt, Gm, and G1, except for the transfer thyristors T1 and T2, the setting thyristors S1 and S2, and the light-emitting thyristors L1 and L2 to be described later.

On the other hand, the gate terminal Gs0 of the setting enabling thyristor S0 is connected to the enabling signal line 76 at "H" (0 V). Accordingly, a threshold voltage of the setting enabling thyristor S0 is −1.5 V obtained by subtracting the diffusion potential Vd (1.5 V) of the pn junction from the potential (0 V) of the gate terminal Gs0.

The gate terminal Gt1 at one end of the transfer thyristor array in FIG. 6 is connected to the cathode terminal of the start diode D0, as described above. Further, the anode terminal of the start diode D0 is connected to the second transfer signal line 73. The second transfer signal line 73 is set to "H". Then, the cathode terminal of the start diode D0 becomes "L" and the anode terminal thereof becomes "H", so that the voltage is applied in a forward direction (forward bias). Thus, the cathode terminal (gate terminal Gt1) of the start diode D0 becomes a value (−1.5 V) obtained by subtracting the diffusion potential Vd (1.5 V) of the start diode D0 from "H" (0 V) of the anode terminal of the start diode D0. Accordingly, a threshold voltage of the transfer thyristor T1 becomes −3.0 V obtained by subtracting the diffusion potential Vd (1.5 V) of the pn junction from the potential (−1.5 V) of the gate terminal Gt1.

Further, the gate terminal Gt2 of the transfer thyristor T2 adjacent to the transfer thyristor T1 is connected to the gate terminal Gt1 through the coupling diode D1. The potential of the gate terminal Gt2 of the transfer thyristor T2 becomes −3.0 V obtained by subtracting the diffusion potential Vd (1.5 V) of the pn junction of the coupling diode D1 from the potential (−1.5 V) of the gate terminal Gt1. Accordingly, a threshold voltage of the transfer thyristor T2 becomes −4.5 V.

The threshold voltage of the transfer thyristor of which the number is 3 or greater is −4.8 V, as described above.

On the other hand, the gate terminal Gs1 of the setting thyristor S1 is connected to the gate terminal Gt1 at −1.5 V through the connection resistance Rx1. Accordingly, as described above, the threshold voltage of the setting thyristor S1 becomes −3.15 V. Further, a threshold voltage of the light-emitting thyristor L1 is −4.35 V.

Similarly, the gate terminal Gs2 of the setting thyristor S2 is connected to the gate terminal Gt2 at −3.0 V through the connection resistance Rx2. Accordingly, a threshold voltage of the setting thyristor S2 becomes −4.35 V. Further, a threshold voltage of the light-emitting thyristor L2 is −4.73 V. The threshold voltages of the setting thyristor S and the light-emitting thyristor L of which the number is 3 or greater is −4.8 V, as described above.

As described above, when the potential of the gate terminal Gt is −3.0 V, the threshold voltages of the setting thyristor S and the light-emitting thyristor L become values smaller than "L" (−3.3 V). Accordingly, even though the setting signal ϕW and the lighting signal ϕI become "L", the setting thyristor S and the light-emitting thyristor L are not turned on. Accordingly, hereinafter, the description regarding a case where the gate terminal Gt is −3 V is not repeated.

Light-Emitting Chip Cb1

In the light-emitting chip Cb1, since the initial state is the same as in the light-emitting chip Ca1, the description will not be repeated.

(2) Time b

At time b shown in FIG. 9, the first transfer signal ϕ1*a* transmitted to the light-emitting chip group #a transitions to "L" (−3.3 V) from "H" (0 V). Thus, the light-emitting device 65 enters into the operation state.

Light-Emitting Chip Ca1

The potential of the first transfer signal line 72 to which the cathode terminals of the odd-numbered transfer thyristors T are connected transitions to "L" (−3.3 V) from "H". Then, the transfer thyristor T1 of which the threshold voltage is −3.0 V is turned on. Further, the potential of the first transfer signal line 72 becomes −1.5 V obtained by subtracting the diffusion voltage Vd (1.5 V) of the pn junction from "H" (0 V) of the anode terminal.

Accordingly, the odd-numbered transfer thyristors T of which the number is 3 or greater, of which the threshold voltage is −4.8 V, are not turned on.

If the transfer thyristor T1 is turned on, the potential of the gate terminal Gt1 becomes "H" (0 V) of the anode terminal.

Further, the potential of the cathode terminal (the first transfer signal line 72 in FIG. 6) of the transfer thyristor T1 becomes −1.5 V obtained by subtracting the diffusion potential Vd (1.5 V) of the pn junction from "H" (0 V) of the anode terminal of the transfer thyristor T1. Then, the coupling diode D1 in which the cathode terminal (gate terminal Gt2) is −3 V is supplied with a forward bias since the anode terminal (gate terminal Gt1) is "H" (0 V). Accordingly, the potential of the cathode terminal (gate terminal Gt2) of the coupling diode D1 becomes −1.5 V obtained by subtracting the diffusion potential Vd (1.5 V) from "H" (0 V) of the anode terminal (gate terminal Gt1). Thus, the threshold voltage of the transfer thyristor T2 becomes −3.0 V.

The potential of the gate terminal Gt3 connected to the gate terminal Gt2 of the transfer thyristor T2 through the coupling diode D2 becomes −3.0 V. Thus, the threshold voltage of the transfer thyristor T3 becomes −4.5 V. In the transfer thyristor T of which the number is 4 or greater, since the potential of the gate terminal Gt is the power source potential Vga ("L" (−3.3 V)), the threshold voltage is maintained at −4.8 V.

On the other hand, if the transfer thyristor T1 is turned on and the potential of the gate terminal Gt1 is "H" (0 V), as described above, the threshold voltage of the setting thyristor S1 becomes −1.78 V. On the other hand, the threshold voltage of the light-emitting thyristor L1 becomes −3.98 V.

Further, if the potential of the gate terminal Gt2 becomes −1.5 V, the threshold voltage of the setting thyristor S2 becomes −3.15 V, and the threshold voltage of the light-emitting thyristor L2 becomes −4.35 V.

However, since the setting signal line 74 and the lighting signal line 75 are "H", the setting thyristors S1 and S2 and the light-emitting thyristors L1 and L2 do not transit to the turned-on state.

That is, at time b, the transfer thyristor T1 is turned on. Further, immediately after time b (here, refers to the time after the change of the thyristor or the like occurs according to the potential change of the signal at time b, a steady state), the transfer thyristor T1 is in the turned-on state. The other transfer thyristors T, all the light-emitting thyristors L, all the setting thyristors S, and the setting enabling thyristor S0 are in the turned-off state.

Hereinafter, the thyristors in the turned-on state (light-emitting thyristors L, transfer thyristors T, setting thyristors S, and setting enabling thyristor S0) will be described, and the thyristors in the turned-off state (light-emitting thyristors L, transfer thyristors T, setting thyristors S, and setting enabling thyristor S0) will not be described.

Light-Emitting Chip Cb1

Since the signal transmitted to the light-emitting chip group #b to which the light-emitting chip Cb1 belongs is not changed, the light-emitting chip Cb1 maintains the initial state.

As described above, the gate terminals (gate terminals Gt, Gs, and Gl) of the thyristors (transfer thyristor T, setting thyristor S, and light-emitting thyristor L) are connected to each other by the diode (coupling diode D) and the resistances (connection resistances Rx and Ry and connection resistance Rz). Accordingly, if the potential of one gate terminal is changed, the potentials of the other gate terminals are changed.

As the potentials of the gate terminals are changed, the threshold voltages of the thyristors are changed.

(3) Time c

At time c, the lighting signal ϕIa transmitted to the light-emitting chip group #a transitions to "L" (−3.3 V) from "H" (0 V).

Light-Emitting Chip Ca1

The lighting signal line 75 connected to the cathode terminal of the light-emitting thyristor L transitions to "L" (−3.3 V) from "H". Since the threshold voltage of the light-emitting thyristor L1 is −3.98 V and the threshold voltage of the light-emitting thyristor of which the number is 2 or greater is −4.35 V or less, no light-emitting thyristors L are turned on.

Accordingly, immediately after time c, the transfer thyristor T1 is in the turned-on state.

Light-Emitting Chip Cb1

Since the signal transmitted to the light-emitting chip group #b to which the light-emitting chip Cb1 belongs is not changed, the light-emitting chip Cb1 maintains the initial state.

(4) Time d

At time d, the enabling signal ϕEa transmitted to the light-emitting chip group #a transitions to "L" (−3.3 V) from "H" (0 V).

Light-Emitting Chip Ca1

The enabling signal line 76 connected to the gate terminal Gs0 of the setting enabling thyristor S0 transitions to "L" (−3.3 V) from "H". Then, the potential of the gate terminal Gs0 of the setting enabling thyristor S0 becomes −3.3 V, and thus, the threshold voltage of the setting enabling thyristor S0 becomes −4.8 V from −1.5 V.

Immediately after time d, the transfer thyristor T1 is in the turned-on state.

Light-Emitting Chip Cb1

Since the signal transmitted to the light-emitting chip group #b to which the light-emitting chip Cb1 belongs is not changed, the light-emitting chip Cb1 maintains the initial state.

(5) Time e

At time e, the setting signal ϕW1 transmitted to the light-emitting chip set #1 to which the light-emitting chip Ca1 of the light-emitting chip group #a and the light-emitting chip Cb1 of the light-emitting chip group #b belong transitions to "L" (−3.3 V) from "H" (0 V).

Light-Emitting Chip Ca1

The potential of the setting signal line 74 connected to the cathode terminal of the setting thyristor S and the setting enabling thyristor S0 transitions to "L" (−3.3 V) from "H". The setting enabling thyristor S0 is not turned on since the threshold voltage is −4.8 V.

On the other hand, the setting thyristor S1 of which the threshold voltage is −1.78 V is turned on. The setting thyristor S2 of which the threshold voltage is −3.15 V is not turned on since the setting thyristor S1 having the higher threshold voltage is first turned on and the setting signal line 74 connected to the cathode terminal of the setting thyristor S1 is set to −1.5 V obtained by subtracting the diffusion potential Vd from the potential of the anode terminal.

If the setting thyristor S1 is turned on, the gate terminal Gs1 becomes 0 V, as described above, and the threshold voltage of the light-emitting thyristor L1 becomes −1.89 V.

At time c, since the lighting signal line 75 becomes "L" (−3.3 V), the light-emitting thyristor L1 is turned on to be lighted (for light emission).

Accordingly, immediately after time e, the transfer thyristor T1 and the setting thyristor S1 are in the turned-on state, and the light-emitting thyristor L1 is in the turned-on state to be lighted (for light emission).

Light-Emitting Chip Cb1

The potential of the setting signal line 74 connected to the cathode terminal of the setting thyristor S and the setting enabling thyristor S0 transitions to "L" (−3.3 V) from "H". The setting enabling thyristor S0 of which the threshold voltage is −1.5 V is turned on, and the potential of the setting signal line 74 is set to −1.5 V. The setting thyristor S1 has the threshold voltage of −3.15 V, and the setting enabling thyristor S0 having the threshold voltage higher than −1.5 V is first turned on. Accordingly, the setting thyristor S1 is not turned on. Thus, the light-emitting thyristor L1 maintains the threshold voltage −4.35 V.

Immediately after time e, the setting enabling thyristor S0 is in the turned-on state.

(6) Time f

At time f, the setting signal ϕW1 transmitted to the light-emitting chip group #1 to which the light-emitting chip Ca1 of the light-emitting chip group #a and the light-emitting chip Cb1 of the light-emitting chip group #b belong transitions to "H" (0 V) from "L" (−3.3 V).

Light-Emitting Chip Ca1

The potential of the setting signal line 74 connected to the cathode terminal of the setting thyristor S and the setting enabling thyristor S0 transitions to "H" (0 V) from "L". The setting thyristor S1 is turned off since both of the anode terminal and the cathode terminal of the setting thyristor S1 become H (0 V).

However, the light-emitting thyristor L1 maintains the turned-on state to be lighted (for light emission).

Since the light-emitting thyristor L1 is in the turned-on state, the potential of the gate terminal G1 becomes 0 V. Further, the potential of the gate terminal Gt1 becomes 0 V. Thus, the potential of the gate terminal Gs1 is also 0 V, and the threshold voltage of the setting thyristor S1 is −1.5 V.

Accordingly, immediately after time f, the transfer thyristor T1 is in the turned-on state, and the light-emitting thyristor L1 is in the turned-on state to be lighted (for light emission).

Light-Emitting Chip Cb1

The potential of the setting signal line 74 connected to the cathode terminal of the setting thyristor S and the setting enabling thyristor S0 transitions to "H" (0 V) from "L". The setting enabling thyristor S0 is turned off since both of the anode terminal and the cathode terminal of the setting enabling thyristor S0 become H (0 V).

(7) Time g

At time g, the first transfer signal ϕ1*b* transmitted to the light-emitting chip group #b transitions to "L" (−3.3 V) from "H" (0 V).

Light-Emitting Chip Ca1

Since the signal transmitted to the light-emitting chip group #a to which the light-emitting chip Ca1 belongs is not changed, the state immediately after time f is maintained.

Light-Emitting Chip Cb1

The operation of the light-emitting chip Cb1 is the same as the operation of the light-emitting chip Ca1 at time b. That is, the potential of the first transfer signal line 72 connected to the cathode terminals of the odd-numbered transfer thyristors T transitions to "L" (−3.3 V) from "H". Further, the transfer thyristor T1 is turned on. Thus, the potential of the first transfer signal line 72 becomes −1.5 V. Further, the threshold voltage of the transfer thyristor T2 becomes −3 V, and the threshold voltage of the setting thyristor S1 becomes −1.78 V.

That is, the light-emitting chip Cb1 operates at the timing when the operation of the light-emitting chip Ca1 is shifted on the time axis (here, it is assumed that the phase is shifted by 180°)

(8) Time h

At time h, the enabling signal ϕEa transmitted to the light-emitting chip group #a transitions to "H" (0 V) from "L" (−3.3 V).

Light-Emitting Chip Ca1

The enabling signal line 76 connected to the gate terminal Gs0 of the setting enabling thyristor S0 transitions to "H" (0 V) from "L". Further, the potential of the gate terminal Gs0 of the setting enabling thyristor S0 becomes 0 V, and the threshold voltage of the setting enabling thyristor S0 returns to −1.5 V. The setting enabling thyristor S0 is not turned on since the setting signal line 74 is "H" (0 V).

Here, the light-emitting thyristor L1 maintains the turned-on state to be lighted (for light emission). Accordingly, immediately after time h, the transfer thyristor T1 is in the turned-on state, and the light-emitting thyristor L1 is in the turned-on state to be lighted (for light emission)

Light-Emitting Chip Cb1

Since the signal transmitted to the light-emitting chip group #b to which the light-emitting chip Cb1 belongs is not changed, the state immediately after time g is maintained.

(9) Time i

At time i, the lighting signal ϕIb transmitted to the light-emitting chip group #b transitions to "L" (−3.3 V) from "H" (0 V).

Light-Emitting Chip Ca1

Since the signal transmitted to the light-emitting chip group #a to which the light-emitting chip Ca1 belongs is not changed, the state immediately after time h is maintained.

Light-Emitting Chip Cb1

Since the operation of the light-emitting chip Cb1 is the same as the operation of the light-emitting chip Ca1 at time c, the detailed description thereof will not be repeated. Immediately after time i, the transfer thyristor T1 is in the turned-on state.

(10) Time j

At time j, the enabling signal ϕEb transmitted to the light-emitting chip group #b transitions to "L" (−3.3 V) from "H" (0 V).

Light-Emitting Chip Ca1

Since the signal transmitted to the light-emitting chip group #a to which the light-emitting chip Ca1 belongs is not changed, the state immediately after time h is maintained.

Light-Emitting Chip Cb1

Similar to the operation of the light-emitting chip Ca1 at time d, the threshold voltage of the setting enabling thyristor S0 becomes −4.8 V.

Immediately after time j, the transfer thyristor T1 is in the turned-on state.

(11) Time k

At time k, the setting signal ϕW1 transmitted to the light-emitting chip set #1 to which the light-emitting chip Ca1 of the light-emitting chip group #a and the light-emitting chip Cb1 of the light-emitting chip group #b belong transitions to "L" (−3.3 V) from "H" (0 V).

Light-Emitting Chip Ca1

The potential of the setting signal line 74 connected to the cathode terminal of the setting thyristor S and the setting enabling thyristor S0 transitions to "L" (−3.3 V) from "H". Here, the threshold voltage of the setting enabling thyristor S0 and the threshold voltage of the setting thyristor S1 are all −1.5 V.

Accordingly, both or any one of the setting enabling thyristor S0 and the setting thyristor S1 is turned on. For example, even though the setting thyristor S1 is turned on, since the light-emitting thyristor L1 is already in the turned-on state, the state change does not occur.

Accordingly, the light-emitting thyristor L1 maintains the turned-on state to be lighted (for light emission).

Immediately after time k, since the transfer thyristor T1, the setting enabling thyristor S0 and/or the setting thyristor S1 are in the turned-on state, the light-emitting thyristor L1 is in the turned-on state to be lighted (for light emission).

As described later, when the light-emitting thyristor L1 is in the turned-off state, since the threshold voltage of the setting thyristor S1 is −1.78 V, the setting enabling thyristor S0 of which the threshold voltage is −1.5 V is turned on.

Light-Emitting Chip Cb1

Similar to the operation of the light-emitting chip Ca1 at time e, the potential of the setting signal line 74 connected to the cathode terminal of the setting thyristor S and the setting enabling thyristor S0 transitions to "L" (−3.3 V) from "H". The setting enabling thyristor S0 is not turned on since the threshold voltage thereof is −4.8 V. On the other hand, the setting thyristor S1 of which the threshold voltage is −1.78 V is turned on. Thus, the light-emitting thyristor L1 of which the threshold voltage becomes −1.5 V is turned on to be lighted (for light emission).

Immediately after time k, the transfer thyristor T1 and the setting thyristor S1 are in the turned-on state, and the light-emitting thyristor L1 is in the turned-on state to be lighted (for light emission).

(12) Time l

At time l, the setting signal ϕW1 transmitted to the light-emitting chip set #1 to which the light-emitting chip Ca1 of the light-emitting chip group #a and the light-emitting chip Cb1 of the light-emitting chip group #b belong transitions to "H" (0 V) from "L" (−3.3 V).

Light-Emitting Chip Ca1

The potential of the setting signal line 74 connected to the cathode terminal of the setting thyristor S and the setting enabling thyristor S0 transitions to "H" (0 V) from "L". Accordingly, the anode terminal and the cathode terminal of the setting enabling thyristor S0 and/or the setting thyristor S1 are all "H" (0 V), and thus, the setting enabling thyristor S0 and/or the setting thyristor S1 is turned off. Here, the light-emitting thyristor L1 maintains the turned-on state to be lighted (for light emission).

Immediately after time 1, the transfer thyristor T1 is in the turned-on state, and the light-emitting thyristor L1 is in the turned-on state to be lighted (for light emission)

Light-Emitting Chip Cb1

Similar to the operation of the light-emitting chip Ca1 at time f, the setting thyristor S1 is turned off. However, the light-emitting thyristor L1 maintains the turned-on state to be lighted (for light emission). Immediately after time f, the transfer thyristor T1 is in the turned-on state, and the light-emitting thyristor L1 is in the turned-on state to be lighted (for light emission).

(13) Time m

At time m, the second transfer signal ϕ2*a* transmitted to the light-emitting chip group #a transitions to "L" (−3.3 V) from "H" (0 V).

Light-Emitting Chip Ca1

The potential of the second transfer signal line 73 connected to the cathode terminals of the even-numbered transfer thyristors T transitions to "L" (−3.3 V) from "H". The transfer thyristor T2 of which the threshold voltage is −3 V is turned off. However, the even-numbered transfer thyristor T of which the number is 4 or greater is not turned on since the threshold voltage thereof is −4.8 V. If the transfer thyristor T2 is turned on, the gate terminal Gt2 becomes "H" (0 V). Then, the potential of the gate terminal Gt3 connected to the gate terminal Gt2 of the transfer thyristor T2 through the coupling diode D2 becomes −1.5 V. Thus, the threshold voltage of the transfer thyristor T3 becomes −3.0 V. Further, the potential of the second transfer signal line 73 becomes −1.5 V.

On the other hand, if the transfer thyristor T2 is turned on and the gate terminal Gt2 becomes "H" (0 V), as described above, the threshold voltage of the setting thyristor S2 becomes −1.78 V. However, since the potential of the setting signal line 74 is "H", the setting thyristor S2 is not turned on. Further, the threshold voltage of the light-emitting thyristor L2 becomes −3.98 V. Here, since the potential of the lighting signal line 75 is −1.5 V due to the light-emitting thyristor L1 in the turned-on state, the light-emitting thyristor L2 is not turned on.

That is, at time m, the transfer thyristor T2 is turned on.

Further, immediately after time m, the transfer thyristor T1 and the transfer thyristor T2 are in the turned-on state, and the light-emitting thyristor L1 is in the turned-on state to be lighted (for light emission).

Light-Emitting Chip Cb1

Since the signal transmitted to the light-emitting chip group #b to which the light-emitting chip Cb1 belongs is not changed, the state immediately time 1 is maintained.

(14) Time n

At time n, the first transfer signal $\phi 1a$ transmitted to the light-emitting chip group #a transitions to "H" (0 V) from "L" (−3.3 V).

Light-Emitting Chip Ca1

The potential of the first transfer signal line 72 connected to the cathode terminal of the odd-numbered transfer thyristors T transitions to "H" (0 V) from "L". The transfer thyristor T1 in the turned-on state is turned off since the cathode terminal and the anode terminal thereof all become "H". However, since the light-emitting thyristor L1 is in the turned-on state, the potential of the gate terminal Gl1 becomes "H" (0 V). Accordingly, the potential of the gate terminal Gt1 is "H" (0 V), and the threshold voltage of the transfer thyristor T1 is −1.5 V.

Similarly, since the gate terminal Gs1 of the setting thyristor S1 is also 0 V, the threshold voltage of the setting thyristor S1 is −1.5 V.

Immediately after time n, the transfer thyristor T2 is in the turned-on state, and the light-emitting thyristor L1 is in the turned-on state to be lighted (for light emission)

Light-Emitting Chip Cb1

Since the signal transmitted to the light-emitting chip group #b to which the light-emitting chip Cb1 belongs is not changed, the state at time 1 is maintained.

(15) Time o

At time o, the lighting signal ϕIa transmitted to the light-emitting chip group #a transitions to "H" (0 V) from "L" (−3.3 V). Further, the enabling signal ϕEb transmitted to the light-emitting chip group #b transitions to "H" (0 V) from "L" (−3.3 V).

Light-Emitting Chip Ca1

The lighting signal line 75 connected to the cathode terminal of the light-emitting thyristor L transitions to "H" (0 V) from "L". The light-emitting thyristor L1 in the turned-on state is turned off since the cathode terminal and the anode terminal thereof are all "H", and thus, the light is put out (non-lighted). Thus, the potentials of the gate terminals Gl1, Gs1, and Gt1 become the power source potential Vga ("L" (−3.3 V)) through the connection resistance Rz, and the connection resistances Rx and Ry. Thus, the threshold voltage of the transfer thyristor T1 becomes −4.8 V, the threshold voltage of the setting thyristor S1 becomes −1.78 V, and the threshold voltage of the light-emitting thyristor L1 becomes −3.98 V.

The light-emitting thyristor L1 of the light-emitting chip Ca1 is lighted (for light-emission) (that is, turned on) at the timing when the setting signal ϕW1 at time e transitions to "L" from "H", and becomes non-lighted (that is, turned off) at the timing when the lighting signal ϕIa at time o transitions to "H" from "L". A period from time e to time o corresponds to a lighting (light emission) period of the light-emitting thyristor L1 of the light-emitting chip Ca1.

Immediately after time o, the transfer thyristor T2 enters the turned-on state.

Light-Emitting Chip Cb1

As the enabling signal ϕEb transmitted to the light-emitting chip group #b transitions to "H" (0 V) from "L" (−3.3 V), similar to time h of the light-emitting chip Ca1, the potential of the enabling signal line 76 transitions to "H" from "L". Thus, the threshold voltage of the setting thyristor S1 becomes −1.5 V.

Immediately after time o, the transfer thyristor T1 is in the turned-on state, and the transfer thyristor L1 is in the turned-on state to be lighted (for light emission).

In the exemplary embodiment, at time o, the lighting signal ϕIa transmitted to the light-emitting chip group #a transitions to "H" from "L", and the enabling signal ϕEb transmitted to the light-emitting chip group #b transitions to "H" from "L", but these transitions are not necessarily performed at the same time, and any one thereof may be performed earlier.

(16) Time p

At time p, the lighting signal ϕIa transmitted to the light-emitting chip group #a transitions to "L" (−3.3 V) from "H" (0 V).

Light-Emitting Chip Ca1

From time p, the period transitions to the lighting control period Ta(2) of the light-emitting thyristor L2.

Since the first transfer signal $\phi 1a$ and the second transfer signal $\phi 2a$ are changed using the periods Ta(1) and Ta(2) as a cycle, although the waveforms of these signals are different, the operation of the light-emitting chip Ca1 repeats the operation in the period Ta(1) from time c to time p. Accordingly, in the period Ta(2), the operation of the light-emitting chip Ca1 will not be repeated except for the description of the first transfer signal $\phi 1a$ and the second transfer signal $\phi 2a$, and the transfer thyristor T relating to these signals.

Immediately after time p, the transfer thyristor T2 enters the turned-on state.

Light-Emitting Chip Cb1

Since the signal transmitted to the light-emitting chip group #b to which the light-emitting chip Cb1 belongs is not changed, the state immediately after time o is maintained.

Time q is used in a second exemplary embodiment to be described later. Accordingly, in the description of the exemplary embodiment, the description thereof is omitted.

(17) Time r

At time r, the enabling signal ϕEa transmitted to the light-emitting chip group #a transitions to "H" (0 V) from "L" (−3.3 V). Further, the lighting signal ϕIb transmitted to the light-emitting chip group #b transitions to "H" (0 V) from "L" (−3.3 V).

Light-Emitting Chip Ca1

Since the operation at time r is the same as the operation at time h, the description will not be repeated.

Immediately after time r, the transfer thyristor T2 is in the turned-on state, and the light-emitting thyristor L2 is lighted (for light emission).

Light-Emitting Chip Cb1

Similar to the operation of the light-emitting chip Ca1 at time o, the lighting signal ϕIb transitions to "H" (0 V) from "L" (−3.3 V), and the lighting signal line 75 connected to the cathode terminal of the light-emitting thyristor L transitions to "H" (0 V) from "L". Then, the light-emitting thyristor L1 in the turned-on state is turned off since the cathode terminal and the anode terminal thereof all become "H", and is non-lighted. Thus, the threshold voltage of the transfer thyristor T1 becomes −4.8 V, the threshold voltage of the setting thyristor S1 becomes −1.78 V, and the threshold voltage of the light-emitting thyristor L1 becomes −3.98 V.

That is, the light-emitting thyristor L1 of the light-emitting chip Cb1 is lighted (for light emission) (that is, turned on) at the timing when the setting signal ϕW1 at time k transitions to "L" from "H", and becomes non-lighted (that is, turned off) at the timing when the lighting signal ϕIb at time r transitions to "H" from "L". A period from time k to time r corresponds to a lighting (light emission) period of the light-emitting thyristor L1 of the light-emitting chip Cb1.

Immediately after time r, the transfer thyristor T2 enters the turned-on state.

(18) Time s

At time s, the period Tb(1) when the light-emitting thyristor L1 of the light-emitting chip group #b is controlled ends.

(19) Time t

At time t, the first transfer signal ϕ1*a* transmitted to the light-emitting chip group #a to which the light-emitting chip Ca1 belongs transitions to "L" (−3.3 V) from "H" (0 V)

Light-Emitting Chip Ca1

The potential of the first transfer signal line 72 connected to the cathode terminals of the odd-numbered transfer thyristors T transitions to "L" (−3.3V) from "H". The transfer thyristor T3 of which the threshold voltage is −3 V is turned on. Then, the potential of the gate terminal Gt3 becomes "H" (0 V), and the potential of the gate terminal Gt4 becomes −1.5 V. Thus, the threshold voltage of the transfer thyristor T4 becomes −3 V. Further, the threshold voltage of the setting thyristor T3 becomes −1.78 V, and the threshold voltage of the light-emitting thyristor L3 becomes −3.98 V.

Immediately after time t, the transfer thyristors T2 and T3 are in the turned-on state, and the light-emitting thyristor L2 is in the turned-on state to be lighted (for light emission)

Light-Emitting Chip Cb1

Since the signal transmitted to the light-emitting chip group #b to which the light-emitting chip Cb1 belongs is not changed, the state change does not occur.

Immediately after time t, the transfer thyristor T2 is in the turned-on state, and the light-emitting thyristor L2 is in the turned-on state to be lighted (for light emission)

(20) Time u

At time u, the second transfer signal ϕ2*a* transmitted to the light-emitting chip group #a to which the light-emitting chip Ca1 belongs transitions to "H" (0 V) from "L" (−3.3 V)

Light-Emitting Chip Ca1

The potential of the second transfer signal line 73 connected to the cathode terminals of the even-numbered transfer thyristors T transitions to "H" (0 V) from "L". The transfer thyristor T2 in the turned-on state is turned off since the cathode terminal and the anode terminal thereof all become "H".

Immediately after time u, the transfer thyristor T3 is in the turned-on state, and the light-emitting thyristor L2 is in the turned-on state to be lighted (for light emission)

Light-Emitting Chip Cb1

Since the signal transmitted to the light-emitting chip group #b to which the light-emitting chip Cb1 belongs is not changed, the state change does not occur.

Immediately after time u, the transfer thyristor T2 is in the turned-on state, and the light-emitting thyristor L2 is in the turned-on state to be lighted (for light emission)

(21) Others

At time v, the period Ta(2) when the light-emitting thyristor L2 of the light-emitting chip group #a is controlled ends. At time w, the period Tb(2) when the light-emitting thyristor L2 of the light-emitting chip group #b is controlled ends. At time x, the period Ta(3) when the light-emitting thyristor L3 of the light-emitting chip group #a is controlled ends. At time y, the period Tb(3) when the light-emitting thyristor L3 of the light-emitting chip group #b is controlled ends. At time z, the period Ta(4) when the light-emitting thyristor L4 of the light-emitting chip group #a is controlled ends. Similarly, thereafter, the lighting controls of all the light-emitting thyristors L of the light-emitting chips C are performed.

The operations of the above-described light-emitting chips C will be collectively described.

First, the operations of the transfer thyristors T will be described.

In the light-emitting chip C in this exemplary embodiment, the turned-on states of the transfer thyristors T are sequentially moved by the transfer signals of two phases (first transfer signal ϕ1 and second transfer signal ϕ2).

That is, as one transfer signal of the transfer signals of two phase becomes "L" (−3.3 V), the transfer thyristor T in which one transfer signal is transmitted to the cathode terminal enters the turned-on state, and the gate terminal Gt becomes 0 V. The potential of the gate terminal Gt of the adjacent transfer thyristor T connected with the gate terminal Gt at 0 V by the coupling diode D of the forward bias becomes −1.5 V. Thus, the threshold voltage of the adjacent transfer thyristor T becomes high (from −4.5 V to −3 V). Further, the adjacent transfer thyristor T is turned on at the timing when the other transfer signal becomes "L" (−3.3 V).

That is, the transfer signals of two phases (first transfer signal ϕ1 and second transfer signal ϕ2) shift in phase for transmission so that the periods of "L" (−3.3 V) overlap (period from time m to time n in FIG. 9), and thus, the transfer thyristors T are sequentially set to the turned-on state.

If the gate terminal Gt becomes "H" (0 V) in a state where the transfer thyristor T is in the turned-on state, the threshold voltage of the setting thyristor S connected to the gate terminal Gt through the connection resistance Rx becomes high (−1.78 V).

Further, when the enabling signal ϕE (enabling signal ϕEa or ϕϕEb) is "L", if the setting signals 4W (setting signals ϕW1 to ϕW20) transit to "L" from "H", the potential of the setting signal line 74 becomes "L" (−3.3 V), and the setting thyristor S of which the threshold voltage is high (−1.78 V) is turned on.

If the setting thyristor S enters the turned-on state, the gate terminal Gs of the setting thyristor S becomes 0 V, the potential of the gate terminal Gl connected to the gate terminal Gs through the connection resistance Ry also becomes 0 V, and the threshold voltage of the light-emitting thyristor L becomes −1.5 V.

If the lighting signal ϕI (ϕIa or ϕIb) is set to "L" (−3.3 V) before the time when the setting signals ϕW (ϕW1 to ϕW20) become "L" (−3.3 V), at the timing (time) when the setting signals ϕW (ϕW1 to ϕW20) transit to "L" from "H", the light-emitting thyristor L is turned on to be lighted (for light emission).

From the above description, the lighting period when the light-emitting thyristor L is lighted (for light emission) becomes a period from the timing (time) when the setting signals ϕW (setting signals ϕW1 to ϕW20) transit to "L" from "H" to the time (for example, to time o from time e in FIG. 9) when the lighting signal ϕI (ϕIa or ϕIb) transitions to "H" from "NL"

On the other hand, when the setting signals ϕW (ϕW1 to ϕW20) transit to "L" from "H", if the enabling signal ϕE (enabling signal ϕEa or ϕϕEb) is "H", the setting enabling thyristor S0 enters the turned-on state, and the setting signal line 74 is set to −1.5 V (−Vd), and thus, the setting thyristor S is not turned on, and the light-emitting thyristor L is also not turned on.

As described above, when the light-emitting thyristor L is already in the turned-on state, the setting thyristor S may also enter the turned-on state. However, since the light-emitting thyristor L is already in the turned-on state, even though the setting thyristor S enters the turned-on state, the state change does not occur.

In this way, in the light-emitting chip C in which the enabling signal ϕE is "L", the setting enabling thyristor S0 is in the turned-off state, the setting signal ϕW transitions to "L" from "H", and the light-emitting thyristor L is lighted (for light emission). On the other hand, if the enabling signal ϕE is "H", the setting enabling thyristor S0 enters the turned-on state, the setting signal ϕW transitions to "L" from "H", and the light-emitting thyristor L is turned on, which prohibits lighting (light emission). As described above, when the light-emitting thyristor L is in the turned-on state, the state is maintained as it is.

That is, the enabling signals ϕE (enabling signals ϕEa and ϕϕEb) control the threshold voltage of the setting enabling thyristor S0 to set the allowance or disallowance of the turned-on of the light-emitting thyristor L.

In the exemplary embodiment, when the respective light-emitting chips C are lighted (for light emission) together, with respect to the light-emitting chip set formed by the light-emitting chips C that belong to the light-emitting chip group #a and the light-emitting chip group #b, two "L" periods (period from time e to time f and period from time k to time l in FIG. 9) are provided in the commonly transmitted setting signals ϕW (ϕW1 to ϕW20). That is, the former "L" period sets the lighting start with respect to the light-emitting chips C of the light-emitting chip group #a, and the latter "L" period sets the lighting start with respect to the light-emitting chips C of the light-emitting chip group #b.

Further, in the exemplary embodiment, the phases of the transfer signals (first transfer signals ϕ1*a* and ϕ1*b* or second transfer signals ϕ2*a* and ϕ2*b*), the enabling signal ϕE (enabling signal ϕEa or ϕEb), and the lighting signal ϕI (lighting signal ϕIa or ϕIb) to be respectively transmitted to the light-emitting chip group #a and the light-emitting chip group #b are shifted by 180° between the light-emitting chip group #a and the light-emitting chip group #b. Thus, the width (margin) for setting the two "L" periods of the setting signals ϕW (setting signals ϕW1 to ϕW20) is maximized.

That is, since the phases are shifted by 180°, the two "L" times provided in the setting signals ϕW may be set to a ½ period that is the first half of the period T and a ½ period that is the second half thereof.

Further, in the period when the enabling signal ϕE (enabling signal ϕEa or ϕEb) is "L", the setting signals W (ϕW1 to ϕW20) transit to "L" from "H", and thus, the light-emitting thyristor L is lighted.

That is, when the light-emitting thyristor L of the light-emitting chip C of the light-emitting chip group #a is lighted, the setting signals ϕW (ϕW1 to ϕW20) may transit to "L" from "H" in the "L" period of the enabling signal ϕEa to be transmitted to the light-emitting chip group #a. Here, when the light-emitting thyristor L of the light-emitting chip C of the light-emitting chip group #b is not lighted, the enabling signal ϕEb to be transmitted to the light-emitting chip group #b may be set to "H" so that the setting enabling thyristor S0 is turned on. Thus, it is possible to prevent an unintended light-emitting thyristor L from being lighted.

Next, in the light-emitting chips Ca2 and Cb2 that belong to the light-emitting chip set #2, a case where a part of the light-emitting thyristors are not lighted will be described.

As described above, in the light-emitting chip set #2, the light-emitting thyristors L2, L3, and L4 of the light-emitting chip Ca2 are lighted, and the light-emitting thyristors L1, L3, and L4 of the light-emitting chip Cb2 are lighted. Further, the light-emitting thyristor L1 of the light-emitting chip Ca2 and the light-emitting thyristor L2 of the light-emitting chip Cb2 are not lighted.

When the light-emitting thyristor L1 of the light-emitting chip Ca2 is not lighted (non-lighting), in the period from time e to time f when the setting signal ϕW1 is "L" to light the light-emitting thyristor L1 of the light-emitting chip set #1, the setting signal ϕW2 may be maintained at "H". Thus, at time e, the setting signal line 74 of the light-emitting chip Ca2 is maintained at "H" (0 V), and thus, the setting thyristor S1 of which the threshold voltage is −1.78 V is not turned on. Thus, the threshold voltage of the light-emitting thyristor L1 is maintained at −3.98 V, and the light-emitting thyristor L1 is not also turned on, and is not lighted (for light emission).

This is similarly applied to the light-emitting thyristor L2 of the light-emitting chip Cb2.

The light intensity of the light-emitting thyristor L may vary between the light-emitting chips C and the light-emitting thyristors L due to variation of manufacturing conditions or the like. Thus, the correction of the light intensity (light intensity correction) of the light-emitting thyristor L is performed. As a method of the light intensity correction, a method of adjusting electric current that flows in the light-emitting thyristor L, and a method of adjusting the lighting period of the light-emitting thyristor L may be used.

As described above, the lighting period of the light-emitting thyristor L corresponds to the period from the time when the setting signal ϕW transitions to "L" from "H" to turn on the light-emitting thyristor L to the time when the lighting signal ϕI transitions to "H" from "L" to turn off the light-emitting thyristor L. Accordingly, by adjusting the time (for example, time e in FIG. 9) when the setting signal ϕW transitions to "L" from "H", the light intensity of the light-emitting thyristor L is corrected. A non-volatile memory such as a ROM in which the data (light intensity correction data) for correcting the light intensity corresponding to the light-emitting thyristor L is written may be mounted on the circuit board 62, and the data may be read from the ROM to adjust the time when the setting signal ϕW transitions to "L" from "H".

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An optical scanning head comprising:

a plurality of light-emitting element arrays that are arranged along a scanning direction, each of which includes a plurality of light-emitting elements;

a light-emitting control unit that outputs a light-emitting timing signal generated based on image information to each light-emitting element of the plurality of light-emitting element arrays to control light emission of the light-emitting element, the light-emitting timing signal including a light-emitting start signal and a light-emitting end signal of the light-emitting element;

a storage unit that is common to the plurality of light-emitting element arrays and stores a correction value of a light intensity variation due to an arrival time difference between the light-emitting timing signals to the plurality of light-emitting elements; and a correction unit that corrects the light-emitting timing signal based on the correction value and executes a correction for making earlier, to match the light-emitting element having the maximum light intensity in the plurality of light-emitting element arrays, an output timing of the light-emitting start signals of other light-emitting elements.

2. The optical scanning head according to claim 1,
wherein the correction unit performs the correction for the respective light-emitting elements having a same arrangement position in the plurality of light-emitting element arrays using a same correction value.

3. The optical scanning head according to claim 2,
wherein the correction unit adds or subtracts a correction value of an absolute amount at a last stage of a generation process of the light-emitting timing signal.

4. The optical scanning head according to claim 3,
wherein the correction unit corrects the light intensity variation that is mainly caused by a difference of electric resistance depending on wiring lengths for wiring members that transmit the light-emitting timing signal to the respective light-emitting elements on the light-emitting element arrays.

5. The optical scanning head according to claim 2,
wherein the correction unit corrects the light intensity variation that is mainly caused by a difference of electric resistance depending on wiring lengths for wiring members that transmit the light-emitting timing signal to the respective light-emitting elements on the light-emitting element arrays.

6. The optical scanning head according to claim 1,
wherein the correction unit adds or subtracts a correction value of an absolute amount at a last stage of a generation process of the light-emitting timing signal.

7. The optical scanning head according to claim 6,
wherein the correction unit corrects the light intensity variation that is mainly caused by a difference of electric resistance depending on wiring lengths for wiring members that transmit the light-emitting timing signal to the respective light-emitting elements on the light-emitting element arrays.

8. The optical scanning head according to claim 1,
wherein the correction unit corrects the light intensity variation that is mainly caused by a difference of electric resistance depending on wiring lengths for wiring members that transmit the light-emitting timing signal to the respective light-emitting elements on the light-emitting element arrays.

9. An image processing apparatus comprising:
the optical scanning head according to claim 1; and
an image forming unit that radiates light of a light intensity controlled based on image data onto a photoconductor body that is uniformly charged using the optical scanning head to obtain an electrostatic latent image, develops the electrostatic latent image to be visualized, and transfers the developed image to be fixed onto a recording medium.

10. A non-transitory computer readable recording medium storing a light intensity correction control program that causes a computer to execute:
generating a light-emitting timing signal based on image information,
the light-emitting timing signal including a light-emitting start signal and a light-emitting end signal of a light-emitting element;
storing a correction value to be added to or subtracted by a light intensity variation due to an arrival time difference between the light-emitting timing signals to the plurality of respective light-emitting elements provided in a plurality of light-emitting element arrays arranged in a scanning direction, as a common characteristic in the plurality of light-emitting element arrays;
performing correction based on the correction value at a final stage of a generation process of the light-emitting timing signal for each light-emitting element;
controlling light emission of each light-emitting element of the plurality of light-emitting element arrays based on the light-emitting timing signal after correction; and
executing a correction for making earlier, to match the light-emitting element having the maximum light intensity in the plurality of the light-emitting element arrays, an output timing of the light-emitting start signals of other light-emitting elements.

* * * * *